US011521520B2

(12) United States Patent
Han et al.

(10) Patent No.: US 11,521,520 B2
(45) Date of Patent: Dec. 6, 2022

(54) DISPLAY DEVICE

(71) Applicant: LG Display Co., Ltd., Seoul (KR)

(72) Inventors: MiJin Han, Gimpo-si (KR); SeungHee Lee, Goyang-si (KR); Hyosung Lee, Gwangmyeong-si (KR)

(73) Assignee: LG DISPLAY CO., LTD., Seoul (KR)

( * ) Notice: Subject to any disclaimer, the term of this patent is extended or adjusted under 35 U.S.C. 154(b) by 68 days.

(21) Appl. No.: 17/122,605

(22) Filed: Dec. 15, 2020

(65) Prior Publication Data

US 2021/0183275 A1 Jun. 17, 2021

(30) Foreign Application Priority Data

Dec. 16, 2019 (KR) ..... 10-2019-0168281

(51) Int. Cl.
*G09F 9/30* (2006.01)

(52) U.S. Cl.
CPC ..... *G09F 9/301* (2013.01)

(58) Field of Classification Search
CPC ..... G09F 9/301; G06F 1/1641; G06F 1/1652; G06F 2203/04102
See application file for complete search history.

(56) References Cited

U.S. PATENT DOCUMENTS

| | | | | |
|---|---|---|---|---|
| 11,272,626 | B2 * | 3/2022 | Lee | G06F 1/1601 |
| 2015/0227171 | A1 * | 8/2015 | Choi | G06F 1/1652 361/749 |
| 2017/0013726 | A1 * | 1/2017 | Han | G09F 15/0062 |
| 2017/0161868 | A1 * | 6/2017 | Kim | G09F 9/301 |
| 2017/0318688 | A1 | 11/2017 | Kim et al. | |
| 2018/0070467 | A1 * | 3/2018 | Kim | B21B 39/008 |
| 2018/0341142 | A1 * | 11/2018 | Choi | G06F 1/1652 |
| 2019/0150300 | A1 * | 5/2019 | Kim | H05K 5/0217 361/807 |
| 2020/0107458 | A1 * | 4/2020 | Park | G06F 1/1652 |
| 2020/0154580 | A1 * | 5/2020 | Shin | G02F 1/133305 |
| 2020/0170114 | A1 * | 5/2020 | Choi | H05K 5/0217 |
| 2020/0214149 | A1 * | 7/2020 | Lee | H05K 5/0017 |
| 2020/0394942 | A1 * | 12/2020 | Kim | G06F 1/1601 |
| 2021/0029839 | A1 * | 1/2021 | Kwon | H05K 5/0217 |
| 2021/0051809 | A1 * | 2/2021 | Song | G06F 1/1652 |
| 2021/0074189 | A1 * | 3/2021 | Kwon | G06F 1/1652 |
| 2021/0083024 | A1 * | 3/2021 | Song | H01L 51/0097 |
| 2021/0127512 | A1 * | 4/2021 | Lee | G06F 1/1601 |

FOREIGN PATENT DOCUMENTS

| | | | |
|---|---|---|---|
| CN | 201254414 | Y | 6/2009 |
| CN | 105518767 | A | 4/2016 |
| CN | 107342018 | A | 11/2017 |
| CN | 107452282 | A | 12/2017 |
| CN | 108257508 | A | 7/2018 |
| KR | 10-2013-0055263 | A | 5/2013 |
| KR | 10-2017-0124120 | A | 11/2017 |
| KR | 20200031933 | A * | 3/2020 |

OTHER PUBLICATIONS

Chinese Office Action dated Jun. 27, 2022 issued in Patent Application No. 202011408807.0 (10 pages) with English translation.

* cited by examiner

*Primary Examiner* — Joe H Cheng
(74) *Attorney, Agent, or Firm* — Polsinelli PC

(57) ABSTRACT

A display device includes a display panel, a roller configured to wind or unwind the display panel, a flexible cable configured to transmit an electrical signal to the display panel and including an extension part to be wound around the end of the roller.

23 Claims, 18 Drawing Sheets

PA(PA1,PA2)
MA(MA1,MA3)
FA(FA1,FA2)
1510(1510a,1510b)
170(1570a,170b)

DISPLAY DEVICE

CROSS-REFERENCE TO RELATED APPLICATION

This application claims the priority of Korean Patent Application No. 10-2019-0168281 filed on Dec. 16, 2019, which is hereby incorporated by reference in its entirety.

BACKGROUND

Field of the Disclosure

The present disclosure relates to a display device, and more particularly, to a rollable display device which may display an image even when rolled up.

Description of the Background

Display device used for a computer monitor, a TV, a mobile phone, etc. include an organic light-emitting display (OLED) that emits light by itself, a liquid-crystal display (LCD) that requires a separate light source, etc.

As the display devices have been increasingly applied to diverse fields such as a computer monitor, a TV, and a personal mobile device, display devices having a large display area and a reduced volume and weight have been studied.

Recently, a rollable display device in which a display part, wiring lines, etc. are formed on a flexible substrate made of flexible plastic and which may display an image even when rolled up has attracted attention as a next-generation display device.

SUMMARY

The present disclosure is to provide a display device in which a twist of a flexible cable during winding or unwinding of the flexible cable may be reduced.

The present disclosure is also to provide a display device in which a flexible cable may be fixed.

The present disclosure is also to provide a display device of which of reliability may be improved.

The present disclosure is not limited to the above-mentioned features, which are not mentioned above, can be clearly understood by those skilled in the art from the following descriptions.

According to an aspect of the present disclosure, a display device is provided. The display device includes a display panel and a roller configured to wind or unwind the display panel. The display panel also includes a flexible cable configured to transmit an electrical signal to the display panel and including an extension part to be wound around the end of the roller.

According to another aspect of the present disclosure, a display device is provided. The display device includes a display panel configured to display an image and a back cover configured to be rolled together with the display panel. The display device also includes a roller configured to wind or unwind the back cover and the display panel and a plurality of flexible films placed on one end of the display panel. The display device further includes a source printed circuit board connected to the plurality of flexible films. The display device also includes a flexible cable including a connection part connected to the source printed circuit board and an extension part extended from one side of the connection part and configured to be wound as the roller is rotated. The display device further includes a control printed circuit board electrically connected to the source printed circuit board through the flexible cable and an elastic member placed on at least one surface of the extension part.

Other detailed matters of the exemplary embodiments are included in the detailed description and the drawings.

According to the present disclosure, a flexible cable is configured to be wound around the roller. Thus, it is possible to suppress a twist of the flexible cable.

According to the present disclosure, the flexible cable is fixed and thus may be stably wound or unwound.

According to the present disclosure, an elastic member is disposed in the flexible cable, and, thus, the flexible cable may be easily unwound.

According to the present disclosure, the driving stability of a display device may be improved.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1A:
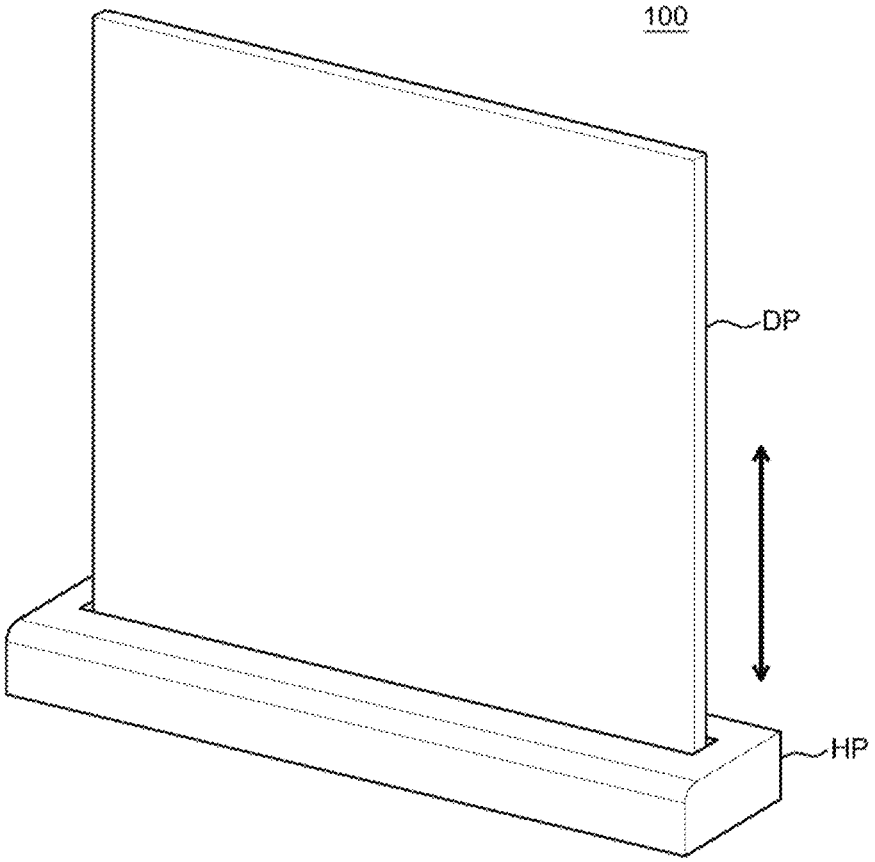
FIG. 1A and FIG. 1B are perspective views of a display device according to an exemplary embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Hereinafter, a display device according to exemplary embodiments of the present disclosure will be described in detail with reference to accompanying drawings.

Display Device—Rollable Display Device

A rollable display device may refer to a display device which may display an image even when rolled up. The rollable display device may have higher flexibility than conventional typical display devices. The rollable display device may be freely changed in shape depending on whether the rollable display device is used or not. Specifically, when the rollable display device is not used, the rollable display device may be housed as rolled up to reduce its volume. When the rollable display device is used, the rolled rollable display device may be unrolled again.

Figure 1B:
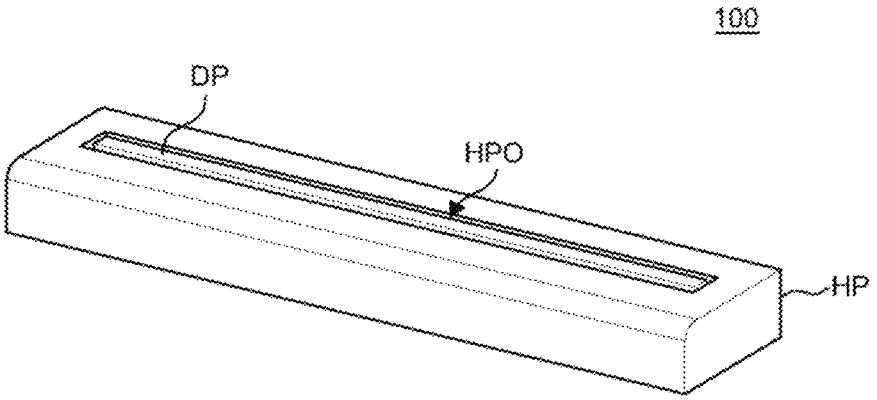
Figure 2:
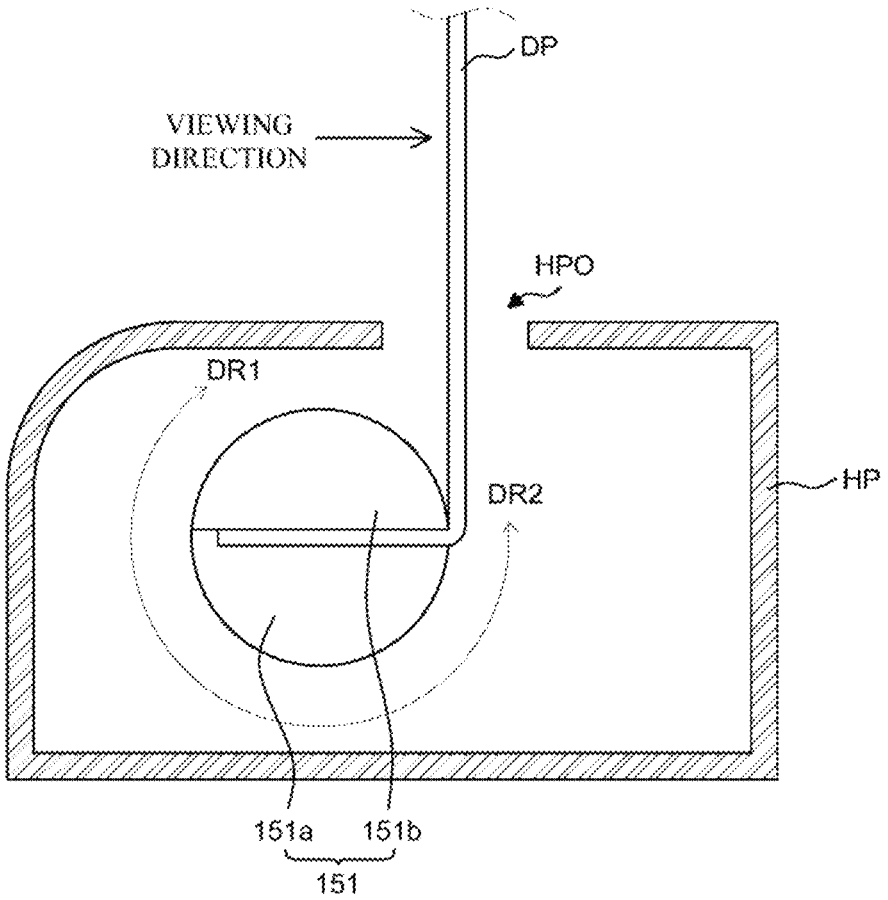
FIG. 2 is a cross-sectional view of the display device according to an exemplary embodiment of the present disclosure.

FIG. 1A and FIG. 1B are perspective views of a display device according to an exemplary embodiment of the present disclosure. FIG. 2 is a cross-sectional view of the display device according to an exemplary embodiment of the present disclosure.

Referring to FIG. 1A and FIG. 1B, a display device 100 according to an exemplary embodiment of the present disclosure includes a display part DP and a housing part HP.

The display part DP is configured to display images to a user. For example, display elements, circuits for driving the display elements, wiring lines, and other components may be disposed in the display part DP. Herein, the display device 100 according to an embodiment of the present disclosure is a rollable display device 100. Therefore, the display part DP may be configured to be wound and unwound. For example, the display part DP may include a display panel and a back cover which are flexible so as to be wound or unwound. More details of the display part DP will be described later with reference to FIG. 3 and FIG. 4.

The housing part HP serves as a case where the display part DP may be housed. The display part DP may be wound and then housed inside the housing part HP, and the display part DP may be unwound and then presented outside the housing part HP.

The housing part HP includes an opening HPO through which the display part DP may move in and out of the housing part HP. The display part DP may move up and down through the opening HPO of the housing part HP.

Meanwhile, the display part DP of the display device 100 may transit from a full unwinding state to a full winding state, or vice versa.

FIG. 1A shows a full unwinding state of the display part DP of the display device 100. The full unwinding state refers to a state where the display part DP of the display device 100 is presented outside the housing part HP. That is, the full unwinding state may be defined as a state where the display part DP is unwound to a maximum so as not to be further unwound and presented outside the housing part HP in order for the user to watch images on the display device 100.

FIG. 1B shows a full winding state of the display part DP of the display device 100. The full winding state refers to a state where the display part DP of the display device 100 is housed inside the housing part HP and may not be further wound. That is, the full winding state may be defined as a state where the display part DP is wound and housed inside the housing part HP when the user does not watch images on the display device 100 because the display part DP housed inside the housing part HP is preferable for the sake of external appearance. Further, in the full winding state where the display part DP is housed inside the housing part HP, the display device 100 is reduced in volume and easy to transport.

Further, the display part DP of the display device 100 may transit from the full winding state to a partial unwinding state. The partial unwinding state of the display part DP refers to a state where a part of the display part DP is presented outside the housing part HP.

Referring to FIG. 2, the display part DP may transit to the full unwinding state, the full winding state or the partial unwinding state by a moving part and a roller 151. For convenience in explanation, FIG. 2 illustrates only the housing part HP, the display part DP and the roller 151.

The roller 151 may be housed in the housing part HP and configured to wind or unwind the display part DP. Specifically, the roller 151 may be housed in the housing part HP and configured to fix a lower edge of the display part DP and wind or unwind the display part DP while rotating clockwise or counterclockwise. For example, when the roller 151 rotates in a first direction DR1, i.e., clockwise, the display part DP may be wound around the roller 151 so that a front surface of the display part DP facing the viewing direction may be closely contacted with a surface of the roller 151. Also, when the roller 151 rotates in a second direction DR2, i.e., counterclockwise, the display part DP wound around the roller 151 may be unwound from the roller 151 and then presented outside the housing part HP.

The roller 151 may include a base part 151*a* and a top cover 151*b*. The lower edge of the display part DP may be fixed between the base part 151*a* and the top cover 151*b* and combined to the roller 151. For example, the roller 151 in which the base part 151*a*, the top cover 151*b* and the display part DP are combined with each other may have a cylindrical shape. However, the shape of the roller 151 is not necessarily limited thereto. The roller 151 may have various shapes around which the display part DP may be wound.

Also, the roller 151 may wind the display part DP using elasticity.

Specifically, a spring may be disposed on one side of the roller 151. When the roller 151 rotates in the second direction DR2 to unwind the display part DP, the spring is compressed. Also, when a force of rotating the roller 151 in the second direction DR2 is canceled, the spring rotates the roller 151 in the first direction DR1 using elasticity to wind the display part DP around the roller 151. In this case, the display part DP unwound from the roller 151 is applied with a rotation force of the roller 151 to wind the display part DP by elasticity of the spring. Thus, the display part DP exposed outside the housing part HP may be maintained in a flat state.

Display Part

Figure 3:
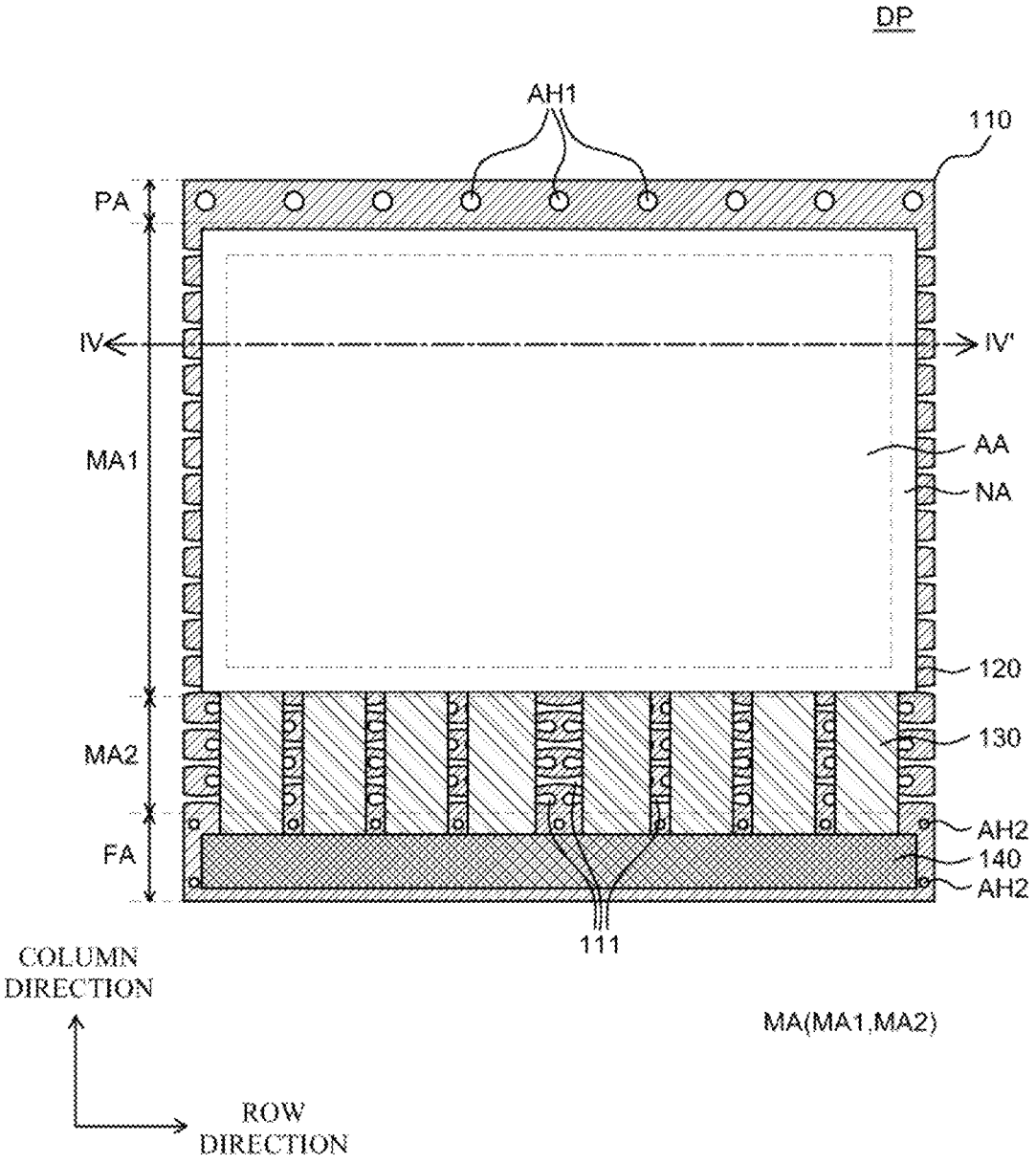
FIG. 3 is a plan view of a display part of the display device according to an exemplary embodiment of the present disclosure.
Figure 4:
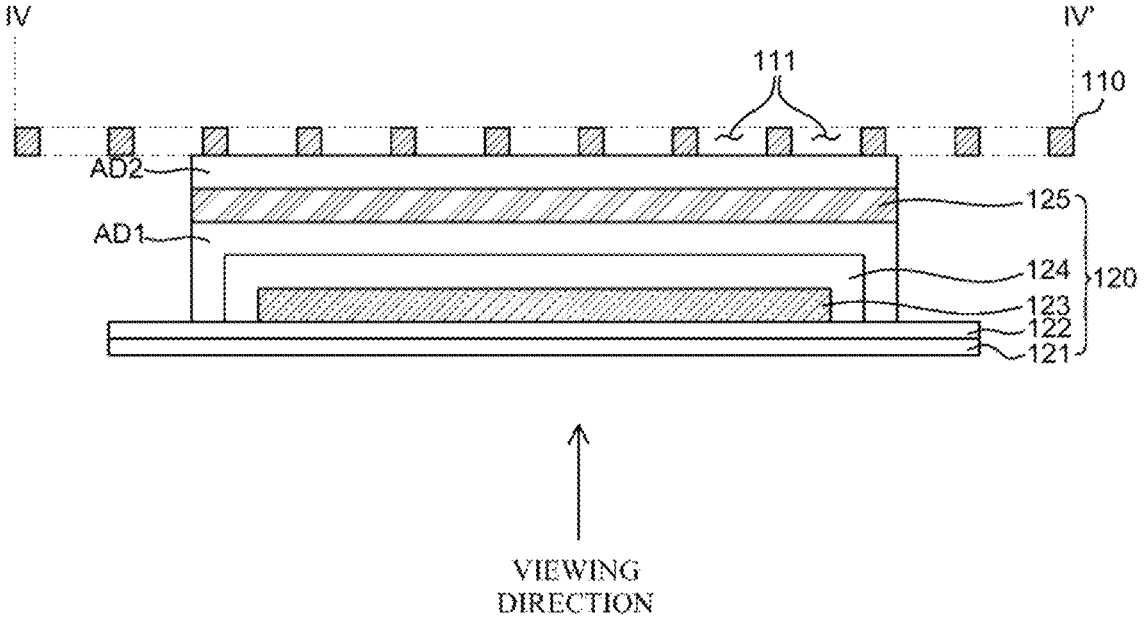
FIG. 4 is a cross-sectional view as taken along line IV-IV' of FIG. 3.

FIG. 3 is a plan view of a display part of the display device according to an exemplary embodiment of the present disclosure. FIG. 4 is a cross-sectional view as taken along a line IV-IV' of FIG. 3.

Referring to FIG. 3, the display part DP of the display device 100 includes a back cover 110, a display panel 120, a flexible film 130, a source printed circuit board 140 and a cable cover. For convenience in explanation, FIG. 3 does not illustrate a flexible cable 170 and a control printed circuit board of the display part DP.

The back cover 110 is disposed on rear surfaces of the display panel 120, the flexible film 130 and the source printed circuit board 140 and supports the display panel 120, the flexible film 130 and the source printed circuit board 140. Thus, the back cover 110 may be larger in size than the display panel 120. That is, an outer edge of the back cover 110 may be disposed on a further outer side than a corresponding outer edge of the display panel 120. Thus, when the display part DP is presented outside the housing part HP, the back cover 110 may protect the other components of the display part DP, particularly the display panel 120, against external impacts.

The back cover 110 may be formed of a rigid material, but at least a part of the back cover 110 may have flexibility so as to be wound or unwound along with the display panel 120. For example, the back cover 110 may be formed of a metal material such as Steel Use Stainless (SUS) or Invar, or plastic. However, the material of the back cover 110 is not limited thereto. The material of the back cover 110 may be changed variously depending on the design as long as it may satisfy physical property requirements such as amount of thermal deformation, radius of curvature, and rigidity.

The back cover 110 includes a fixing area FA, a support area PA and a flexible area MA. Specifically, the back cover 110 includes the uppermost support area PA, the lowermost fixing area FA and the flexible area MA between the support area PA and the fixing area FA. In the support area PA, a plurality of openings 111 is not disposed. The support area PA is combined to a head bar 164 (see FIG. 5). In the flexible area MA, the plurality of openings 111 is disposed. The flexible area MA is actually wound around or unwound from the roller 151. The fixing area FA serves to fix the back cover 110 to the roller 151 together with the source printed circuit board 140 and the flexible film 130.

The support area PA of the back cover 110 is the uppermost area of the back cover 110 and combined to the head bar 164. The support area PA may include first alignment holes AH1 so as to be combined to the head bar 164. Screws penetrate the first alignment holes AH1 so that the head bar 164 may be combined to the support area PA of the back cover 110. Further, since the support area PA is combined to the head bar 164, the back cover 110 may move up or down at the same time when an elevating unit combined to the head bar 164 moves up or down. The display panel 120 attached to the back cover 110 may also move up or down. FIG. 3 illustrates nine first alignment holes AH1, but the number of first alignment holes AH1 is not limited thereto. Further, FIG. 3 illustrates that the back cover 110 is combined to the head bar 164 using the first alignment holes AH1. However, the present disclosure is not limited thereto. The back cover 110 may be combined to the head bar 164 without alignment holes.

The fixing area FA of the back cover 110 is the lowermost area of the back cover 110 and combined to the roller 151. The fixing area FA may include second alignment holes AH2 so as to be combined to the roller 151. Screws penetrate the second alignment holes AH2 so that the roller 151 may be combined to the fixing area FA of the back cover 110. Further, since the fixing area FA is combined to the roller 151, the back cover 110 may be wound around or unwound from the roller 151 as the roller 151 is rotated. Meanwhile, the number of second alignment holes AH2 illustrated in FIG. 3 is just an example. The number of second alignment holes AH2 may be determined based on the number of source printed circuit boards 140, the number of flexible films 130, etc.

In the fixing area FA, the flexible film 130 and the source printed circuit board 140 connected to one end of the display panel 120 is disposed and fixed. Some of the second alignment holes AH2 through which the screws penetrate may be disposed between the flexible films 130 to more stably fix the flexible films 130. The fixing area FA enables the flexible film 130 and the source printed circuit board 140 to be combined to the roller 151 so as not to be curved but to be flat to protect the flexible film 130 and the source printed circuit board 140. Further, the roller 151 to which the fixing area FA is combined may also be partially flat corresponding to the fixing area FA. More details thereof will be described later with reference to FIG. 5.

The flexible area MA of the back cover 110 is wound around or unwound from the roller 151 together with the display panel 120. The flexible area MA may overlap a part of the display panel 120 and the flexible film 130.

In the flexible area MA of the back cover 110, the plurality of openings 111 is disposed. During winding or unwinding of the display part DP, the plurality of openings 111 may be deformed by stress applied to the display part DP. Specifically, during winding or unwinding of the display part DP, the flexible area MA of the back cover 110 may be deformed as the plurality of openings 111 contracts or expands. Further, since the plurality of openings 111 contracts or expands, a slip phenomenon of the display panel 120 disposed on the flexible area MA of the back cover 110 may be minimized. Therefore, stress applied to the display panel 120 may be minimized.

During winding of the back cover 110 and the display panel 120, there is a difference in length between the back cover 110 and the display panel 120 which are wound around the roller 151. This is because there is a difference in radius of curvature between the back cover 110 and the display panel 120. For example, when the back cover 110 and the display panel 120 are wound around the roller 151, the back cover 110 and the display panel 120 may need different lengths to be wound once around the roller 151. That is, the back cover 110 is disposed farther from the roller 151 than the display panel 120, and, thus, the back cover 110 may need a larger length to be wound once around the roller 151 than the display panel 120. As such, a difference in radius of curvature during winding of the display part DP causes a difference in length for winding of the back cover 110 and the display panel 120. Thus, the display panel 120 attached to the back cover 110 may slip and move from its original position. In this case, a phenomenon that the display panel 120 slips from the back cover 110 due to differences in stress and radius of curvature caused by winding may be defined as slip phenomenon. If slip occurs excessively, the display panel 120 may be detached from the back cover 110 or defects, such as cracks, may occur.

In this case, in the display device 100 according to an exemplary embodiment of the present disclosure, even when the display part DP is applied with stress by being wound or unwound, the plurality of openings 111 of the back cover 110 may be flexibly deformed to reduce stress applied to the back cover 110 and the display panel 120. For example, when the back cover 110 and the display panel 120 are wound around the roller 151, stress that deforms the back cover 110 and the display panel 120 in up and down directions may be applied thereto. In this case, the plurality of openings 111 of the back cover 110 may expand in the up and down directions of the back cover 110 and the length of the back cover 110 may also be flexibly changed. Therefore, during winding of the back cover 110 and the display panel 120, a difference in length between the back cover 110 and the display panel 120 caused by a difference in radius of curvature may be compensated for by the plurality of openings 111 of the back cover 110. Further, during winding of the back cover 110 and the display panel 120, the plurality of openings 111 may be deformed to reduce stress applied to the display panel 120 from the back cover 110.

Meanwhile, the plurality of openings 111 formed in the flexible area MA is not formed in the support area PA and the fixing area FA. That is, only the first alignment holes AH1 and the second alignment holes AH2 are formed in the support area PA and the fixing area FA, respectively. However, the plurality of openings 111 formed in the flexible area MA is not formed in the support area PA and the fixing area FA. Further, the first alignment holes AH1 and the second alignment holes AH2 may be different in shape from the plurality of openings 111. The support area PA and the fixing area FA are fixed to the head bar 164 and the roller 151, respectively, and need to have higher rigidity than the flexible area MA. Specifically, since the support area PA and the fixing area FA have rigidity, the support area PA and the fixing area FA may be securely fixed to the head bar 164 and the roller 151, respectively. Therefore, the display part DP is fixed to the roller 151 and the head bar 164 of the moving part and may move in and out of the housing part HP according to an operation of the moving part.

In the display device 100 according to an exemplary embodiment of the present disclosure, the back cover 110 including the plurality of openings 111 is disposed on the rear surface of the display panel 120 to support and protect the display panel 120. The back cover 110 may be formed of a metal material and thus may have rigidity. Also, the flexible area MA of the back cover 110 in which the display panel 120 is disposed includes the plurality of openings 111, and, thus, the back cover 110 may have improved flexibility. Therefore, in the full unwinding state in which the display part DP of the display device 100 is presented outside the housing part HP, the back cover 110 having high rigidity may support the display panel 120 to be spread flat. In contrast, in the full winding state in which the display part DP of the display device 100 is housed inside the housing part HP, the back cover 110 having high flexibility due to the plurality of openings 111 may be wound around the roller 151 and housed together with the display panel 120.

Referring to FIG. 3, the flexible area MA may include a first flexible area MA1 extended from the support area PA and a second flexible area MA2 between the first flexible area MA1 and the fixing area FA.

In the first flexible area MA1, a plurality of openings is disposed, and the display panel 120 is attached to the first flexible area MA. The second flexible area MA2 is extended from the first flexible area MA1 to the fixing area FA. In the second flexible area MA2, the plurality of openings 111 is disposed, but the display panel 120 is not disposed. Further, in the second flexible area MA2, at least a part of the flexible film 130 extended from the display panel 120 to the source printed circuit board 140 is disposed.

The second flexible area MA2 is extended to enable an active area AA of the display panel 120 to be presented outside the housing part HP. For example, when the back cover 110 and the display panel 120 are in the full unwinding state, the fixing area FA to which the source printed circuit board 140 is attached and which is fixed to the roller 151 and the second flexible area MA2 to which the flexible film 130 is attached may be placed inside the housing part HP. At the same time, the first flexible area MA1 and the support area PA to which the display panel 120 is attached may be presented outside the housing part HP.

The display panel 120 is configured to display images to the user. In the display panel 120, display elements for displaying images, driving elements for driving the display elements, and wiring lines for transmitting various signals to the display elements and the driving elements may be disposed.

The display elements may be defined differently depending on the kind of the display panel 120. For example, if the display panel 120 is an organic light emitting display panel, the display elements may be organic light emitting elements each composed of an anode, an organic emission layer, and a cathode. For example, if the display panel 120 is a liquid crystal display panel, the display elements may be liquid crystal display elements. Further, if the display panel 120 is a light emitting display panel including an LED, the display elements may be LEDs. Hereinafter, the display panel 120 will be assumed as an organic light emitting display panel, but the display panel 120 is not limited to the organic light emitting display panel. Further, since the display device 100 according to an exemplary embodiment of the present disclosure is a rollable display device, the display panel 120 may be implemented as a flexible display panel to be wound around or unwound from the roller 151.

Referring to FIG. 3, the display panel 120 includes the active area AA and a non-active area NA.

The active area AA refers to an area where an image is displayed on the display panel 120. In the active area AA, a plurality of sub-pixels forming a plurality of pixels and driving circuits for driving the plurality of sub-pixels may be disposed. The plurality of sub-pixels is a minimum unit of the active area AA, and a display element may be disposed on each of the plurality of sub-pixels. For example, an organic light emitting element composed of an anode, an organic emission layer, and a cathode may be disposed on each of the plurality of sub-pixels, but the present disclosure is not limited thereto. Further, the driving circuits for driving the plurality of sub-pixels may include driving elements, wiring lines, etc. For example, each driving circuit may be composed of a thin film transistor, a storage capacitor, a gate line, a data line, etc., but is not limited thereto.

The non-active area NA refers to an area where an image is not displayed. The non-active area NA surrounds the active area AA. In the non-active area NA, various wiring lines and circuits for driving the organic light emitting elements in the active area AA may be disposed. For example, link lines for transmitting signals to the plurality of sub-pixels and circuits in the active area AA or driving ICs such as a gate driver IC and a data driver IC may be disposed in the non-active area NA. However, the present disclosure is not limited thereto.

The flexible film 130 includes various components on a flexible base film. Since the flexible film 130 has flexibility, a part of the flexible film 130 may be wound around or unwound from the roller 151 together with the second flexible area MA2. The flexible film 130 serves to supply signals to the plurality of sub-pixels and circuits in the active area AA. The flexible film 130 may be electrically connected to the display panel 120. The flexible film 130 is placed on one end of the non-active area NA of the display panel 120 and supplies power voltage, data voltage, etc. to the plurality of sub-pixels and circuits in the active area AA. The number of flexible films 130 illustrated in FIG. 3 is just an example and is not limited thereto. The number of flexible films 130 may be changed variously depending on the design.

Meanwhile, on the flexible film 130, driving ICs such as a gate driver IC and a data driver IC may also be disposed. The driving ICs are configured to process data for displaying an image and a driving signal for processing the data. The driving ICs may be mounted in a Chip On Glass (COG) method, a Chip On Film (COF) method, or a Tape Carrier Package (TCP). For convenience in explanation, the driving ICs are described as mounted on the flexible film 130 in the COF method, but the present disclosure is not limited thereto.

The source printed circuit board 140 is disposed on one end of the flexible film 130 and connected to the flexible film 130. The source printed circuit board 140 is configured to supply signals to the driving ICs. The source printed circuit board 140 supplies various signals such as a driving signal, a data signal, etc. to the driving ICs. In the source printed circuit board 140, various components may be disposed. For example, a timing controller, a power supply unit, etc. may be disposed on the source printed circuit board 140. FIG. 3 illustrates a single source printed circuit board 140. However, the number of source printed circuit boards 140 is not limited thereto and may be changed variously depending on the design.

Referring to FIG. 4, the display panel 120 includes a substrate 121, a buffer layer 122, a pixel unit 123, an encapsulation layer 124, and an encapsulation substrate 125.

The substrate 121 serves as a base member to support various components of the display panel 120 and may be formed of an insulating material. The substrate 121 may be formed of a flexible material in order for the display panel 120 to be wound or unwound. For example, the substrate 121 may be formed of a plastic material such as polyimide (PI).

The buffer layer 122 may suppress diffusion of moisture and/or oxygen permeating from the outside of the substrate 121. The buffer layer 122 may be formed as a single layer or a multilayer of silicon oxide (SiOx) and silicon nitride (SiNx) but is not limited thereto.

The pixel unit 123 includes a plurality of organic light emitting elements and circuits for driving the organic light emitting elements. The pixel unit 123 may correspond to the active area AA. Each organic light emitting element may include an anode, an organic emission layer, and a cathode.

The anode may supply holes into the organic emission layer and may be formed of a conductive material having a high work function. For example, the anode may be formed of tin oxide (TO), indium tin oxide (ITO), indium zinc oxide (IZO), indium zinc tin oxide (ITZO), or the like, but is not limited thereto.

The organic emission layer may receive holes from the anode and electrons from the cathode and emit light. The organic emission layer may be one of a red organic emission layer, a green organic emission layer, a blue organic emission layer, and a white organic emission layer depending on the color of light emitted from the organic emission layer. In this case, if the organic emission layer is a white organic emission layer, color filters of various colors may be further provided.

The cathode may supply electrons into the organic emission layer and may be formed of a conductive layer having a low work function. For example, the cathode may be formed of one or more materials selected from the group consisting of metals such as magnesium (Mg), silver (Ag), and aluminum (Al) and alloys thereof, but is not limited thereto.

Meanwhile, the display panel 120 may be classified into a top emission type or a bottom emission type according to a transmission direction of light emitted from the organic light emitting element.

In the top emission type, light emitted from the organic light emitting element is discharged toward the upper side of the substrate 121 on which the organic light emitting element is formed. If the display panel 120 is of top emission type, a reflective layer may be further provided under the anode. This is to discharge light emitted from the organic light emitting element toward the upper side of the substrate 121, i.e., toward the cathode.

In the bottom emission type, light emitted from the organic light emitting element is emitted toward the lower side of the substrate 121 on which the organic light emitting element is formed. If the display panel 120 is of bottom emission type, the anode may be formed of a transparent conductive material only and the cathode may be formed of a metal material having high reflectivity. This is to discharge light emitted from the organic light emitting element toward the lower side of the substrate 121.

Hereafter, for convenience in explanation, the display device 100 according to an embodiment of the present disclosure will be described as a bottom emission type display device, but is not limited thereto.

In the pixel unit 123, a circuit for driving organic light emitting elements is disposed. The circuit may be composed of a TFT, a storage capacitor, a gate line, a data line, a power line, etc. The components of the circuit may be changed variously depending on the design of the display device 100.

The encapsulation layer 124 covering the pixel unit 123 is disposed on the pixel unit 123. The encapsulation layer 124 seals the organic light emitting elements of the pixel unit 123. The encapsulation layer 124 may protect the organic light emitting elements of the pixel unit 123 against external moisture, oxygen, and impacts. The encapsulation layer 124 may be formed by alternately laminating a plurality of inorganic layers and a plurality of organic layers. For example, the inorganic layers may be formed of inorganic materials such as silicon nitride (SiNx), silicon oxide (SiOx), and aluminum oxide (AlOx), but are not limited thereto. For example, the organic layers may be formed of epoxy-based or acryl-based polymers, but are not limited thereto.

The encapsulation substrate 125 is disposed on the encapsulation layer 124. The encapsulation substrate 125 protects the organic light emitting elements of the pixel unit 123 together with the encapsulation layer 124. The encapsulation substrate 125 may protect the organic light emitting elements of the pixel unit 123 against external moisture, oxygen, and impacts. The encapsulation substrate 125 may be formed of a metal material which has high corrosion resistance and may be easily processed into foil or thin film. Examples of the metal material may include aluminum (Al), nickel (Ni), chromium (Cr), and an alloy of iron (Fe) and Ni. Since the encapsulation substrate 125 is formed of a metal material, the encapsulation substrate 125 may be implemented in the form of an ultra-thin film and may provide high resistance to external impacts and scratches.

A first adhesive layer AD1 may be disposed between the encapsulation layer 124 and the encapsulation substrate 125. The first adhesive layer AD1 may bond the encapsulation layer 124 and the encapsulation substrate 125. The first adhesive layer AD1 may be formed of an adhesive material and may be a thermosetting or naturally-curable adhesive. For example, the first adhesive layer AD1 may be formed of an optical clear adhesive (OCA), a pressure sensitive adhesive (PSA), or the like, but is not limited thereto.

Meanwhile, the first adhesive layer AD1 may be disposed to cover the encapsulation layer 124 and the pixel unit 123. That is, the pixel unit 123 may be sealed by the buffer layer 122 and the encapsulation layer 124 and the encapsulation layer 124 and the pixel unit 123 may be sealed by the buffer layer 122 and the first adhesive layer AD1. The first adhesive layer AD1 may protect the organic light emitting elements of the pixel unit 123 against external moisture, oxygen, and impacts together with the encapsulation layer 124 and the encapsulation substrate 125. Herein, the first adhesive layer AD1 may further contain a moisture absorbent. The moisture absorbent may include hygroscopic particles and may absorb moisture and oxygen from the outside to minimize permeation of moisture and oxygen into the pixel unit 123.

The back cover 110 is disposed on the encapsulation substrate 125. The back cover 110 may be disposed to be in contact with the encapsulation substrate 125 of the display panel 120 to protect the display panel 120. The back cover 110 may be formed of a rigid material to protect the display panel 120.

A second adhesive layer AD2 is disposed between the encapsulation substrate 125 and the back cover 110. The second adhesive layer AD2 may bond the encapsulation substrate 125 and the back cover 110. The second adhesive layer AD2 may be formed of an adhesive material and may be a thermosetting or naturally-curable adhesive. For example, the second adhesive layer AD2 may be formed of an optical clear adhesive (OCA), a pressure sensitive adhesive (PSA), or the like, but is not limited thereto.

FIG. 4 illustrates that a plurality of openings 111 of the back cover 110 is not filled with the second adhesive layer AD2. However, some or all of the plurality of openings 111 of the back cover 110 may be filled with the second adhesive layer AD2. When the second adhesive layer AD2 fills in the plurality of openings 111 of the back cover 110, a contact area between the second adhesive layer AD2 and the back cover 110 increases. Thus, it is possible to suppress separation therebetween.

Meanwhile, although not illustrated in FIG. 4, a light transmitting film may be further disposed on a front surface of the substrate 121. The light transmitting film may function to protect a front surface of the display panel 120 or minimize reflection of external light incident into the display panel 120. For example, the light transmitting film may be at least one of a polyethyleneterephthalate (PET) film, an anti-reflection film, a polarizing film, and a transmittance controllable film, but is not limited thereto.

Combination Structure of Display Part and Roller

Figure 5:
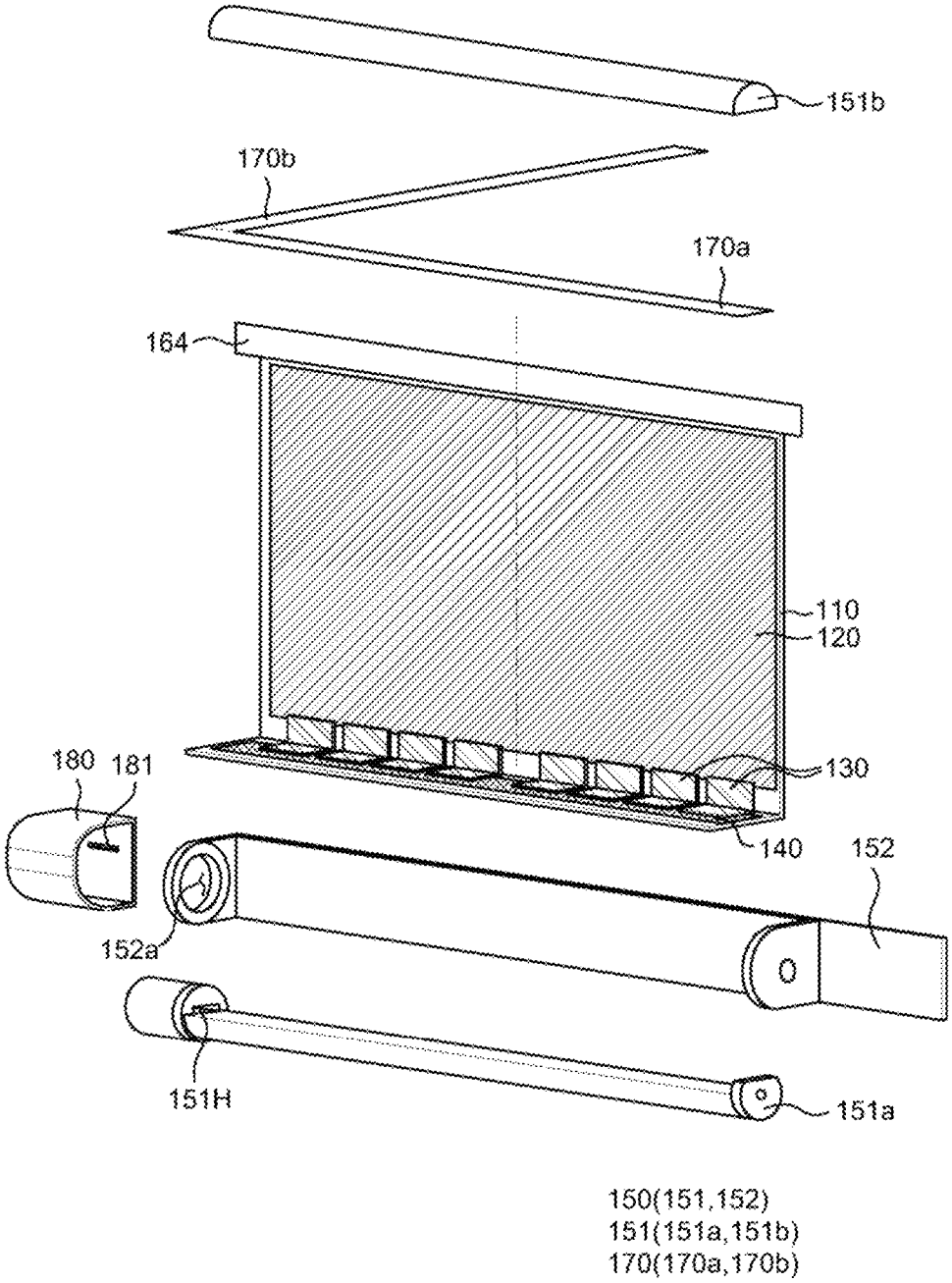
FIG. 5 is an exploded perspective view of the display device according to an exemplary embodiment of the present disclosure.

FIG. 5 is an exploded perspective view of the display device according to an exemplary embodiment of the present disclosure.

Referring to FIG. 5, a roller unit 150 may include the roller 151 configured to wind or unwind the display part DP and a roller support unit 152 configured to rotatably support both ends of the roller 151.

The roller 151 may include a plurality of semi-cylindrical members which may be separated from and combined with each other. Further, the lower edge of the display part DP may be fixed between the plurality of semi-cylindrical members. Thus, when the roller 151 rotates clockwise or counterclockwise, the display part DP may be wound around or unwound from the roller 151. Also, one side of the roller 151 may be extended and penetrate a through-hole 152*a* of the roller support unit 152. Thus, the roller 151 may be rotatably combined with the roller support unit 152.

The roller support unit 152 supports the roller 151 from both sides of the roller 151. Specifically, the roller support unit 152 may be disposed in the housing part HP, but is not limited thereto. The roller support unit 152 may include a bracket member provided in the housing part HP and a bearing member combined with the bracket member and rotatably supporting the roller 151.

Referring to FIG. 5, the lower edge of the display part DP is fixed between the base part 151*a* and a cover part 151*b* of the roller 151. Specifically, the fixing area FA of the back cover 110, a part of the flexible film 130, the source printed circuit board 140 and a connection part 170*a* are disposed between the base part 151*a* and the cover part 151*b*.

A part of an outer peripheral surface of the base part 151*a* is flat and the other part of the outer peripheral surface is curved. The fixing area FA of the back cover 110, a part of the flexible film 130, the source printed circuit board 140 and the connection part 170*a* may be mounted on the flat part of the base part 151*a*. The fixing area FA is fixed to the flat part of the base part 151*a* using the plurality of second alignment holes AH2.

The cover part 151*b* is combined onto the flat part of the base part 151*a*. More specifically, screws penetrating the cover part 151*b* of the roller 151, the fixing area FA of the back cover 110 and the base part 151*a* of the roller 151 may be disposed. Thus, the roller 151 may be combined to the fixing area FA.

An upper surface of the cover part 151*b* may have a convex curved shape. Further, the curved shape of the cover part 151*b* may correspond to the curved part of the base part 151*a*. Thus, after the base part 151*a* and the cover part 151*b* are combined with each other, a cross section of the roller 151 may have a substantially circular shape. Therefore, the fixing area FA, a part of the flexible film 130, the source printed circuit board 140 and the connection part 170*a* may be disposed on the flat part of the base part 151*a*. Then, the flexible area MA of the back cover 110 and the display panel 120 may be wound along an outer peripheral surface of the roller 151 having a circular shape.

Referring to FIG. 5, a flexible cable 170 is disposed on the source printed circuit board 140. The flexible cable 170 may electrically connect the source printed circuit board 140 and a control printed circuit board to transmit an electrical signal to the display panel 120. The flexible cable 170 may be, for example, a flexible flat cable (FFC), but is not limited thereto.

The flexible cable 170 includes the connection part 170*a* and an extension part 170*b* extended from one side of the connection part 170*a*. The connection part 170*a* of the flexible cable 170 is directly connected to the source printed circuit board 140 and the extension part 170*b* is directly connected to the control printed circuit board. Thus, the source printed circuit board 140 and the control printed circuit board may be electrically connected by the flexible cable 170.

The connection part 170*a* may be disposed in a band shape on the source printed circuit board 140. In this case, the connection part 170*a* may be extended to correspond to an extension direction of the roller 151. A part of the connection part 170*a* may also be disposed to overlap the source printed circuit board 140. However, the present disclosure is not limited thereto. The connection part 170*a* may be disposed so as not to overlap the source printed circuit board 140.

The extension part 170*b* may be extended from the end of the connection part 170*a*. For example, the extension part 170*b* may be extended in a direction perpendicular to a longitudinal direction of the connection part 170*a*, but is not limited thereto. One end of the extension part 170*b* may be connected to the connection part 170*a* and the other end of the extension part 170*b* which is not connected to the connection part 170*a* may be connected to the control printed circuit board. The extension part 170*b* is formed into a band shape so as to be wound around the end of the roller 151 as the roller 151 is rotated. The extension part 170*b* will be described in more detail with reference to FIG. 6 through FIG. 7B.

Referring to FIG. 5, a cable cover 180 is disposed on one side of the roller 151. The cable cover 180 is disposed to cover the end of the roller 151 and the extension part 170*b* wound around the end of the roller 151 and thus may protect the end of the roller 151 and the extension part 170*b*. The cable cover 180 will be described in more detail with reference to FIG. 6 through FIG. 8.

Meanwhile, the other end of the extension part 170*b* of the flexible cable 170 is connected to the control printed circuit board. The control printed circuit board may be electrically connected to the source printed circuit board 140 through the flexible cable 170 and disposed outside the roller 151. The control printed circuit board may supply the driving ICs, such as a gate driver IC and a data driver IC, with timing signals, power signals, etc. for controlling the driving ICs. For example, in the control printed circuit board, IC chips, such as a timing controller and a power controller, may be mounted. The timing controller and the power controller generate gate control signals such as a gate start pulse, a gate shift clock, and a gate output enable signal and data control signals such as a source start pulse, a source sampling clock, and a source output enable signal.

Meanwhile, the source printed circuit board 140 and the connection part 170*a* disposed in the fixing area FA are disposed on the flat part of the base part 151*a* and thus may be maintained in a flat state without being bent. Therefore, the source printed circuit board 140 and the connection part 170*a* may constantly maintain a flat state regardless of whether the display part DP is wound around or unwound. Also, it is possible to suppress damage to the source printed circuit board 140 and the connection part 170*a* when the source printed circuit board 140 and the connection part 170*a* are bent.

Meanwhile, although not illustrated in FIG. 5, an elevating unit and a transfer unit may be further included in the display device 100. For example, the elevating unit may be disposed to be perpendicular to an extension direction of the head bar 164 on a surface opposite to one surface of the back cover 110 on which the display panel 120 is disposed. Also, the transfer unit may include a sprocket, a motor, etc. The sprocket may be disposed to be engaged with the elevating unit and the motor may supply a driving force to the sprocket. Thus, when the motor is driven, the elevating unit may move up and down as the sprocket is rotated. Therefore, the elevating unit and the transfer unit may move the display part DP up and down.

In some exemplary embodiments, the sprocket may not be used, and a link structure configured to elevate a display panel using a driving force from the motor may be used instead of the elevating unit.

Winding of Extension Part

Figure 6:
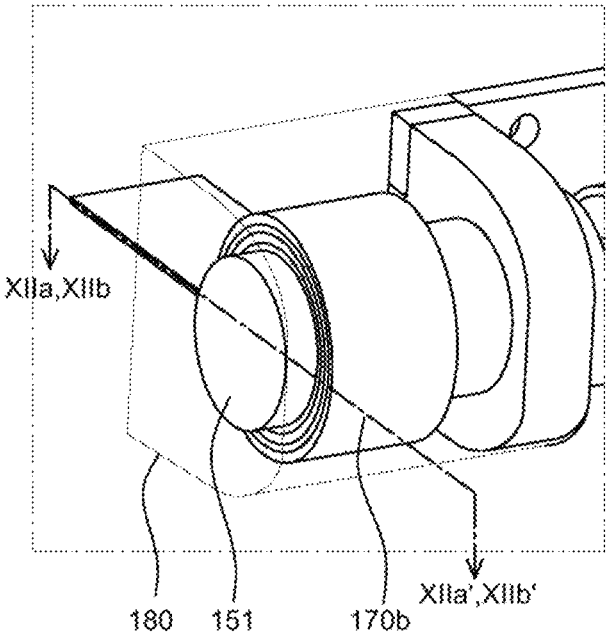
FIG. 6 is a perspective view provided to explain the structure of a roller and a flexible cable of the display device according to an exemplary embodiment of the present disclosure.
Figure 7A:
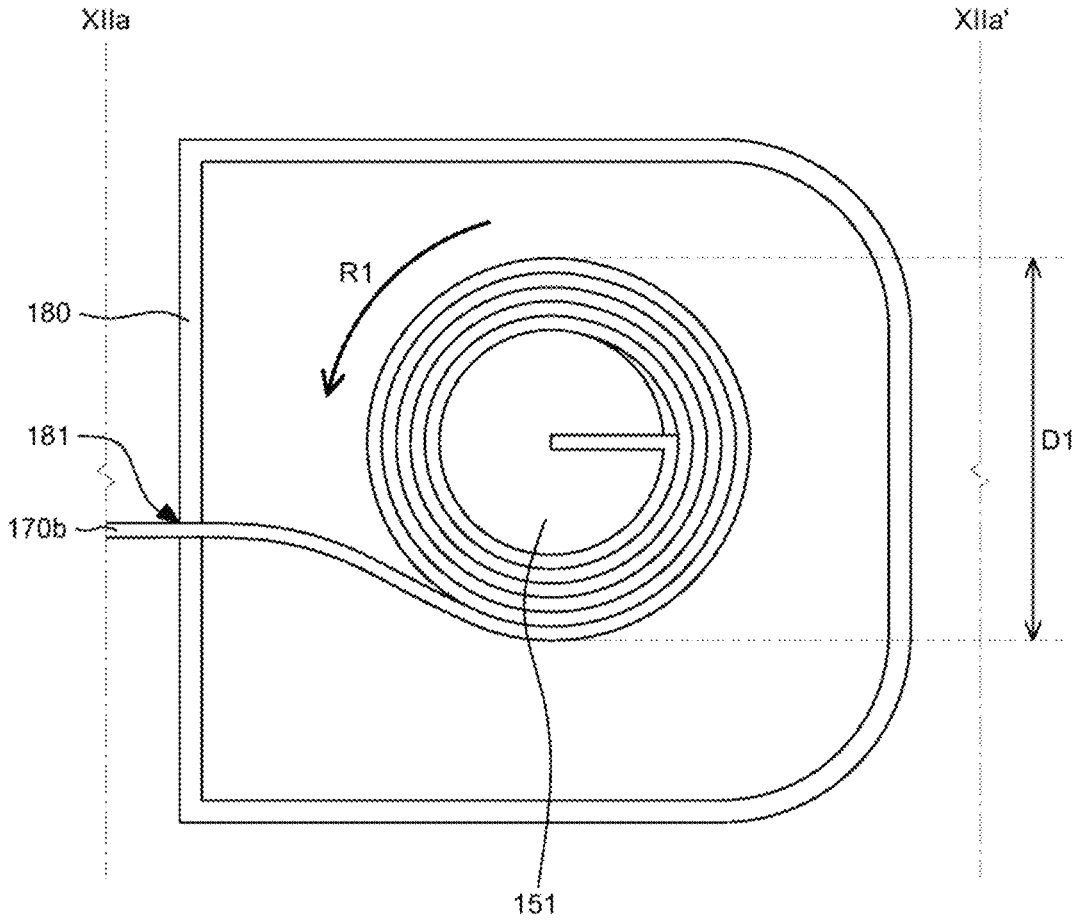
FIG. 7A and FIG. 7B are cross-sectional views of the roller and the flexible cable of the display device according to an exemplary embodiment of the present disclosure.
Figure 7B:
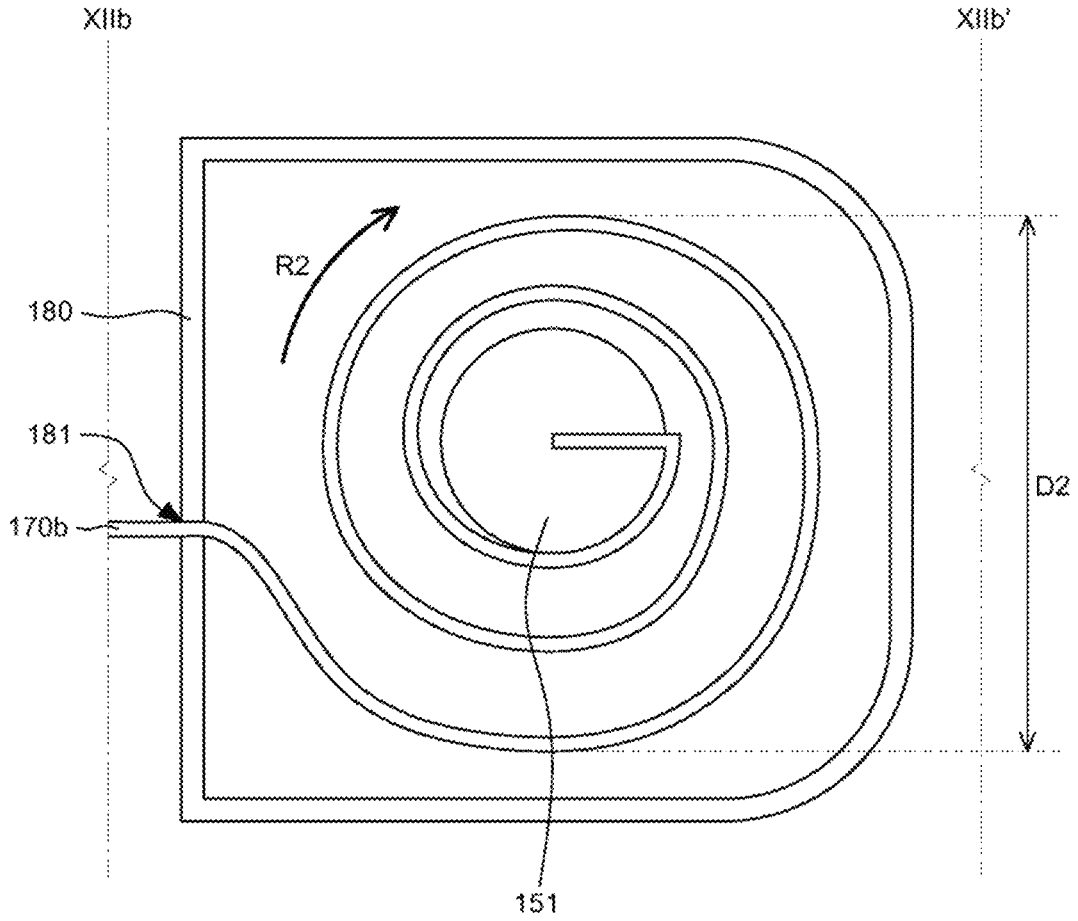
Figure 8:
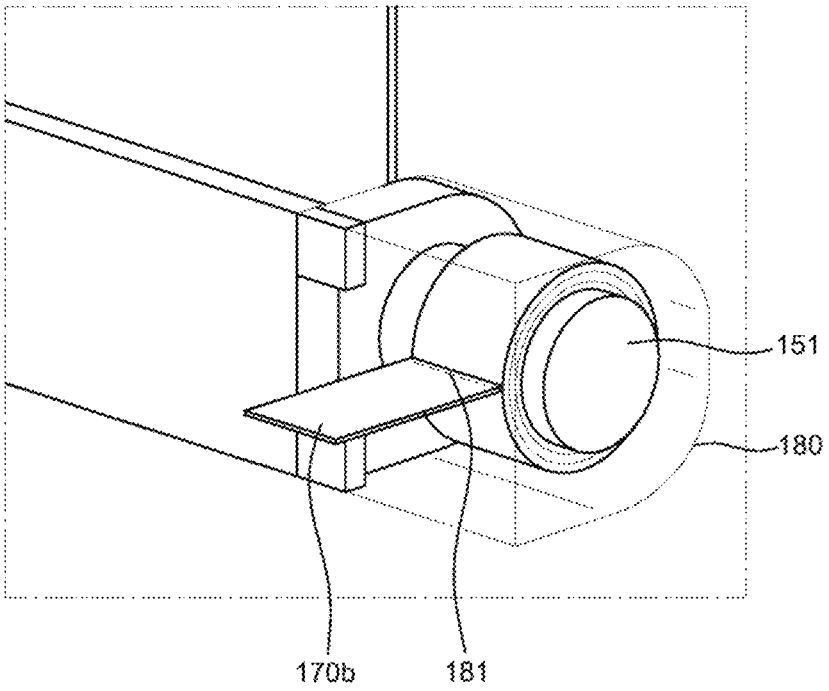
FIG. 8 is a perspective view provided to explain the layout relationship between the flexible cable and a cable cover of the display device according to an exemplary embodiment of the present disclosure.

FIG. 6 is a perspective view provided to explain the structure of a roller and a flexible cable of the display device according to an exemplary embodiment of the present disclosure. FIG. 7A and FIG. 7B are cross-sectional views of the roller and the flexible cable of the display device according to an exemplary embodiment of the present disclosure. FIG. 8 is a perspective view provided to explain the layout relationship between the flexible cable and a cable cover of the display device according to an exemplary embodiment of the present disclosure. Specifically, FIG. 7A is a cross-sectional view as taken along a line XIIa-XIIa' of FIG. 6, and FIG. 7B is a cross-sectional view as taken along a line XIIb-XIIb' of FIG. 6. Hereinafter, FIG. 5 will also be referred to for convenience in explanation.

Referring to FIG. 5 and FIG. 6, the fixing area FA of the back cover 110, the source printed circuit board 140, a plurality of flexible films 130 and the connection part 170*a* of the flexible cable 170 may be disposed sequentially on the flat part of the base part 151*a* of the roller 151. The cover part 151*b* may be disposed to cover the components disposed on the flat part of the base part 151*a*. In this case, the connection part 170*a* of the flexible cable 170 may penetrate the end of the roller 151 and may be extended to the inside of the cable cover 180. Specifically, the connection part 170*a* may penetrate a through-hole 151H of the roller 151 formed in the end of the roller 151 and a part of the connection part 170*a* may be disposed inside the cable cover 180. Thus, the extension part 170*b* connected to the connection part 170*a* may be disposed inside the cable cover 180 so as to be wound around the end of the roller 151. Also, a part of the extension part 170*b* may be disposed outside the cable cover 180 through a fixing hole 181 of the cable cover 180.

Referring to FIG. 6, the extension part 170*b* of the flexible cable 170 is configured to be wound around the roller 151 as the roller 151 is rotated. The extension part 170*b* is disposed in a band shape on the roller 151 except for an area where the display panel 120 and the back cover 110 are wound. Thus, as the roller 151 is rotated, the extension part 170*b* may be wound around or unwound from the end of the roller 151. For example, when the display panel 120 and the back cover 110 are wound around or unwound from the roller 151, the extension part 170*b* may also be wound around or unwound from the end of the roller 151. Herein, the end of the roller 151 around which the extension part 170*b* is wound may be the end of the cover part 151*b* or the end of the base part 151*a*. Thus, the extension part 170*b* is wound around the roller 151 along the shape of the roller 151. Therefore, when the extension part 170*b* is wound around or unwound from the roller 151, a twist does not occur in the extension part 170*b*. Referring to FIG. 7A, the extension part 170*b* disposed inside the cable cover 180 may rotate in a first direction R1 as the roller 151 is rotated and thus may be fully wound around the end of the roller 151. In this case, the extension part 170*b* is wound along the shape of the roller 151. Therefore, when another part of the extension part 170*b* is wound on the extension part 170*b* previously wound around the roller 151, it may be wound along the shape of the roller 151. Accordingly, the distance between the extension parts 170*b* may decrease and an outermost diameter D1 of the extension part 170*b* also may decrease.

Referring to FIG. 7B, the extension part 170*b* may rotate in a second direction R2 as the roller 151 is rotated and thus may be unwound from the roller 151. In this case, a diameter D2 of a part of the extension part 170*b* previously unwound from the roller 151, i.e., the outermost part of the extension part 170*b*, may increase. As the extension part 170*b* wound around the roller 151 is unwound sequentially, a twist does not occur in the extension part 170*b*.

Referring to FIG. 7A and FIG. 7B, when the extension part 170*b* of the flexible cable 170 is wound around or unwound from the roller 151, the display panel 120 may also be wound around or unwound from the roller 151. The display panel 120 is disposed at a central portion of the roller 151 through the back cover 110, the extension part 170*b* is disposed at the end of the roller 151. Thus, as the roller 151 is rotated, the display panel 120 may be wound around or unwound from the central portion of the roller 151 and the extension part 170*b* may be wound around or unwound from the end of the roller 151. For example, as shown in FIG. 7A, when the extension part 170*b* is fully wound around the roller 151, the display panel 120 may also be fully wound around the roller 151. On the contrary, as shown in FIG. 7B, when the extension part 170*b* is unwound from the roller 151, the display panel 120 may also be unwound from the roller 151 and may be maintained in a flat state.

Referring to FIG. 8, the cable cover 180 includes the fixing hole 181. Specifically, the cable cover 180 is disposed to cover the extension part 170*b* wound around the end of the roller 151, and a part of the extension part 170*b* may penetrate the fixing hole 181 and may be disposed outside the cable cover 180. In this case, the fixing hole 181 may fix the extension part 170*b*. That is, the fixing hole 181 may fix the extension part 170*b* in a state where a part of the extension part 170*b* is disposed outside the cable cover 180. Thus, the fixing hole 181 may fix the extension part 170*b* so that even if the extension part 170*b* disposed inside the cable cover 180 is wound around or unwound from the roller 151, the extension part 170*b* disposed outside the cable cover 180 has a uniform length. Even if the roller 151 is rotated, a part of the extension part 170*b* disposed outside the cable cover 180 may not move into the cable cover 180.

In a general rollable display device, a flexible cable is disposed outside a roller and may be rolled up as the roller is rotated. In this case, as the number of rotations of the roller increases, the number of rotations of the flexible cable also increases. Thus, a twist occurs in the flexible cable outside the roller. However, if a twist occurs in the flexible cable, stress increases at the twisted portion of the flexible cable, and, thus, the flexible cable may be cracked or torn, which may cause a short circuit of the flexible cable. Further, the twisted portion of the flexible cable may occupy more space and a connector connected to the flexible cable may be separated.

Accordingly, in the display device 100 according to an exemplary embodiment of the present disclosure, the extension part 170*b* of the flexible cable 170 may be configured to be wound around the end of the roller 151. Thus, during winding or unwinding of the display device 100, it is possible to suppress a twist of the flexible cable 170. For example, the cover part 151*b* and the base part 151*a* of the roller 151 may be combined to each other and may have a cylindrical shape. Thus, when the extension part 170*b* of the flexible cable 170 is wound around the end of the roller 151, the roller 151 may guide the extension part 170*b* about a shape to be wound. Therefore, the extension part 170*b* may be wound around the roller 151 along a circular shape of the roller 151. Thus, during winding of the display device 100, the extension part 170*b* is wound around the end of the roller 151. Therefore, it is possible to suppress a twist of the extension part 170*b* and thus possible to suppress a short circuit of the extension part 170*b*.

Further, in the display device 100 according to an exemplary embodiment of the present disclosure, the fixing hole 181 may be disposed in the cable cover 180 to fix the end of the extension part 170*b*. The cable cover 180 may be disposed to cover the extension part 170*b* wound around the end of the roller 151. Also, a part of the extension part 170*b* may be disposed outside the cable cover 180 through the fixing hole 181 and may be connected to the control printed circuit board. In this case, the fixing hole 181 may fix the extension part 170*b* in a state where a part of the extension part 170*b* is disposed outside the cable cover 180. Thus, the fixing hole 181 may fix the extension part 170*b* so that even if the extension part 170*b* disposed inside the cable cover 180 is wound around or unwound from the roller 151, the extension part 170*b* disposed outside the cable cover 180 has a uniform length.

Elastic Member

Figure 9:
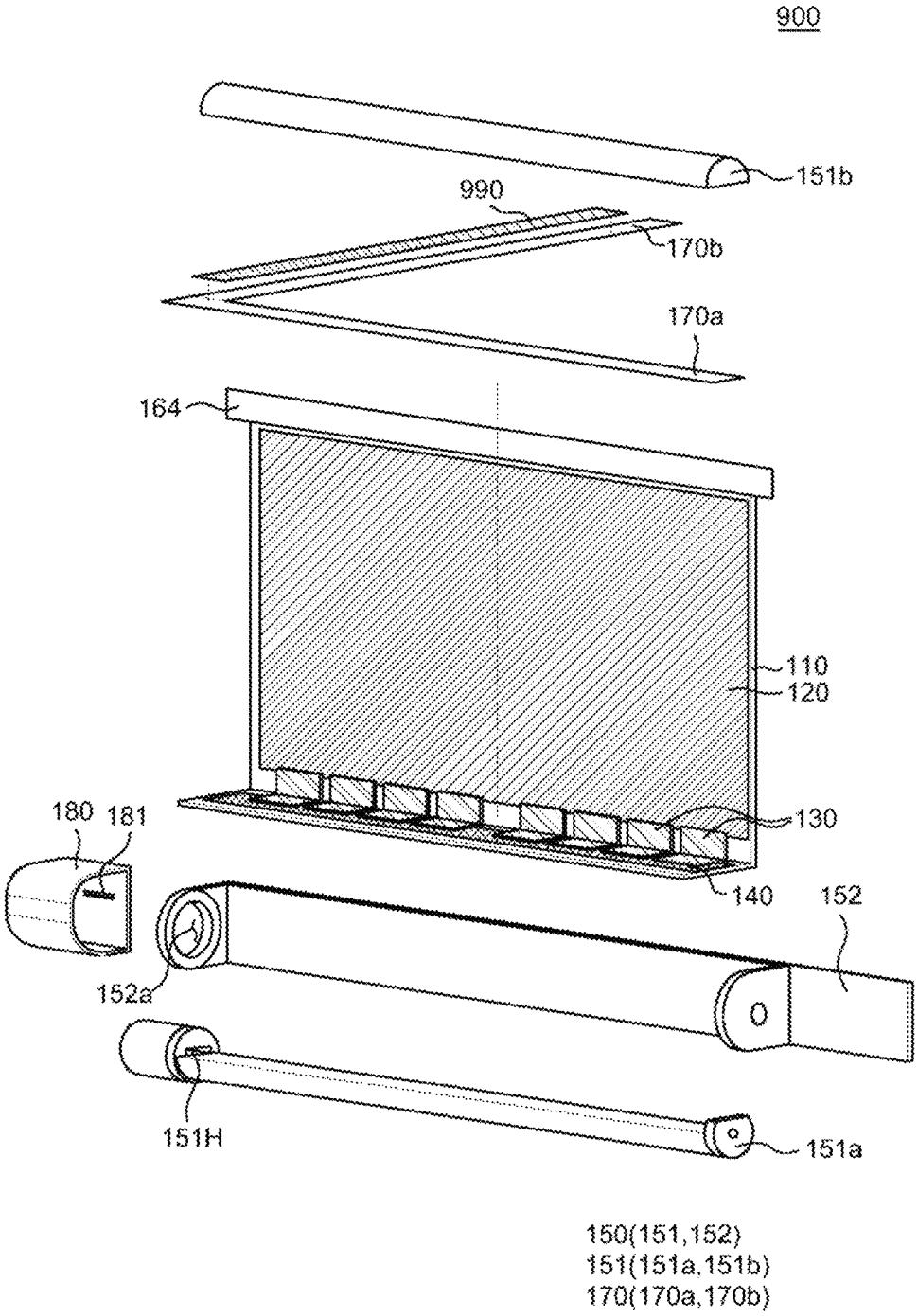
FIG. 9 is an exploded perspective view of a display device according to another exemplary embodiment of the present disclosure.
Figure 10A:
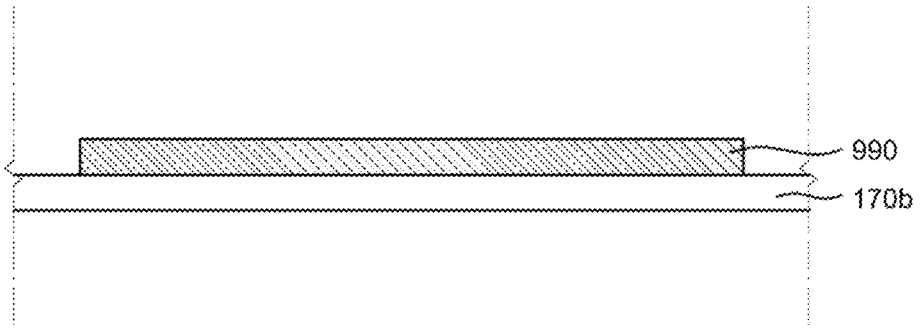
FIG. 10A and FIG. 10B are cross-sectional views provided to explain the layout relationship between a flexible cable and an elastic member of the display device according to another exemplary embodiment of the present disclosure.
Figure 10B:
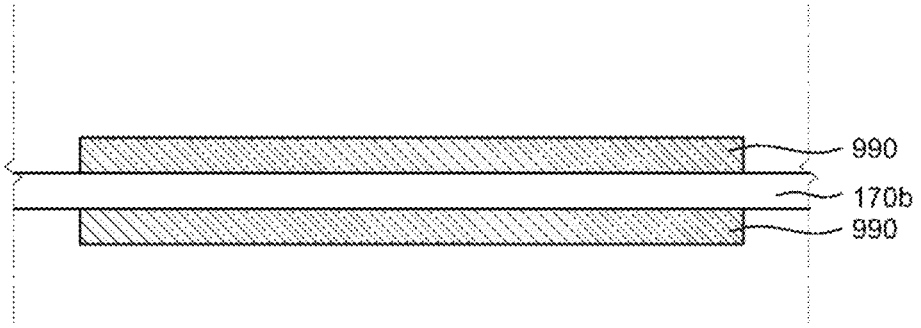
Figure 11A:
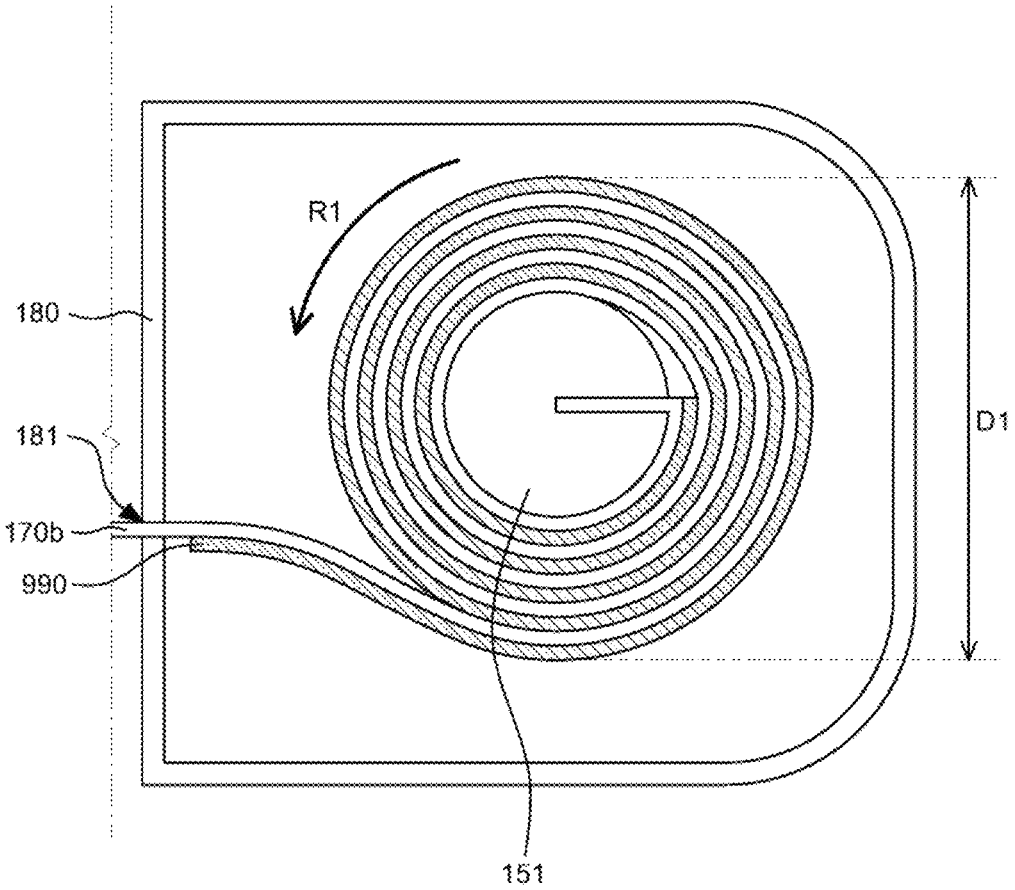
FIG. 11A and FIG. 11B are cross-sectional views of a roller and the flexible cable of the display device according to another exemplary embodiment of the present disclosure.
Figure 11B:
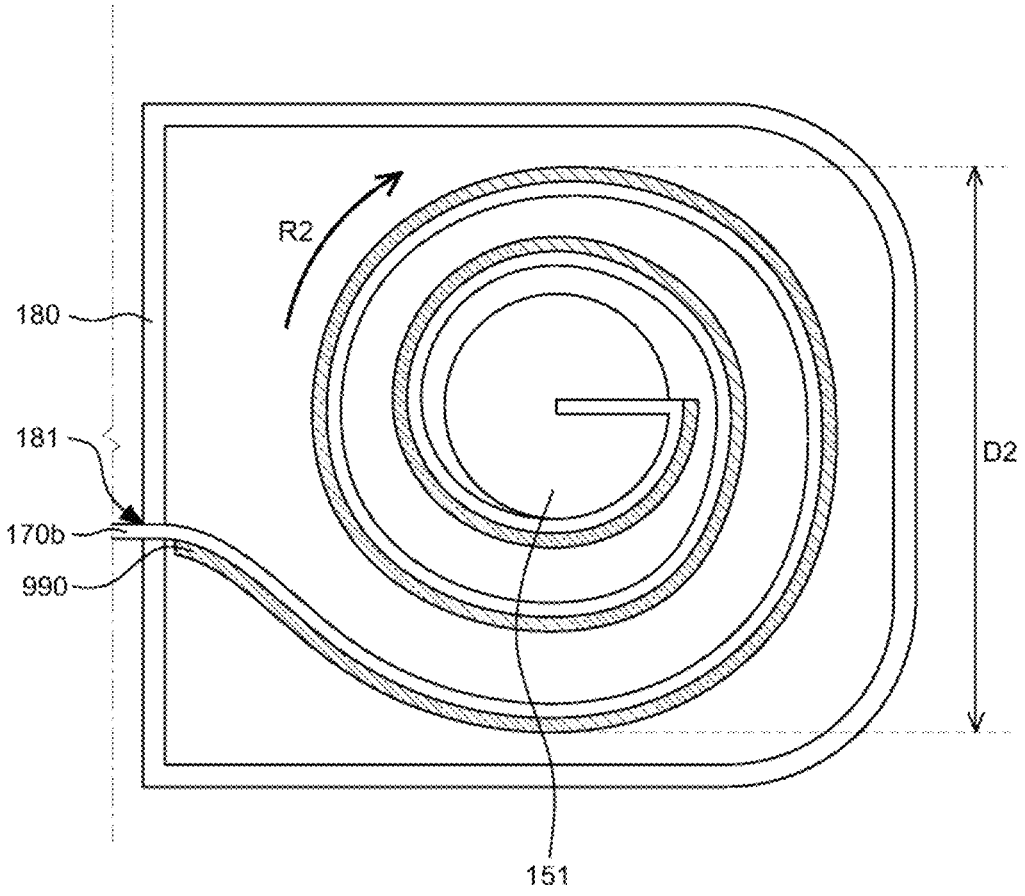

FIG. 9 is an exploded perspective view of a display device according to another exemplary embodiment of the present disclosure. FIG. 10A and FIG. 10B are cross-sectional views provided to explain the layout relationship between a flexible cable and an elastic member of the display device according to another exemplary embodiment of the present disclosure. FIG. 11A and FIG. 11B are cross-sectional views of a roller and the flexible cable of the display device according to another exemplary embodiment of the present disclosure. A display device 900 illustrated in FIG. 9 through FIG. 11B has substantially the same configuration as the display device 100 illustrated in FIG. 1A through FIG. 8 except an elastic member 990. Therefore, redundant description of the same components will not be provided.

Referring to FIG. 9 and FIG. 10A, the elastic member 990 is disposed on at least one surface of the extension part 170*b* of the flexible cable 170. The elastic member 990 has elasticity and may be disposed on one surface of the extension part 170*b* wound around the end of the roller 151. For example, a part of the extension part 170*b* may be disposed outside the cable cover 180 and another part may be wound around the roller 151 inside the cable cover 180. Thus, the elastic member 990 may be disposed with the same width as the extension part 170*b* on one surface of the extension part 170*b* wound around the roller 151 inside the cable cover 180, but is not limited thereto. The elastic member 990 may also be disposed with a different width or length from the extension part 170*b*. Also, the elastic member 990 may be a plate-shaped spring, e.g., a spiral spring, but is not limited thereto.

Referring to FIG. 11A, the extension part 170*b* and the elastic member 990 disposed inside the cable cover 180 may rotate in the first direction R1 as the roller 151 is rotated and thus may be fully wound around the end of the roller 151. In this case, the extension part 170*b* and the elastic member 990 are wound along the shape of the roller 151. Therefore, when another part of the extension part 170*b* and the elastic member 990 is wound on the extension part 170*b* and the elastic member 990 previously wound around the roller 151, it may be wound along the shape of the roller 151. Accordingly, the distance between the extension part 170*b* and the elastic member 990 may decrease and an outermost diameter D1 of the extension part 170*b* and the elastic member 990 may also decrease.

Referring to FIG. 11B, the extension part 170*b* and the elastic member 990 may rotate in the second direction R2 as the roller 151 is rotated and thus may be unwound from the roller 151. In this case, the elastic member 990 may have elasticity so that the extension part 170*b* and the elastic member 990 may be easily unwound from the roller 151. For example, when the extension part 170*b* is unwound from the roller 151, the elastic member 990 may supply an elastic force to the extension part 170*b* so that the extension part 170*b* may be extended from the roller 151. Thus, the extension part 170*b* is more easily unwound from the roller 151 and an outermost diameter D2 of the extension part 170*b* increases.

Meanwhile, referring to FIG. 10B, the elastic member 990 may be disposed on both surfaces of the extension part 170*b*. In this case, the elastic member 990 disposed on one surface of the extension part 170*b* may have a different length or width from the elastic member 990 disposed on the other surface of the extension part 170*b*. The elastic member 990 is disposed on both surfaces of the extension part 170*b*. Thus, during unwinding of the extension part 170*b*, the extension part 170*b* may be more easily unwound from the roller 151.

In the display device 900 according to another exemplary embodiment of the present disclosure, the elastic member 990 may be disposed at least one surface of the extension part 170*b*. Thus, during unwinding of the extension part 170*b*, the elastic member 990 may cause an increase in the outermost diameter of the extension part 170*b*. Since the elastic member 990 is disposed on one surface of the extension part 170*b*, the extension part 170*b* being unwound may be unwound with elasticity from the wound extension part 170*b*. That is, when the extension part 170*b* is unwound, the elastic member 990 may cause an increase in the outermost diameter of the extension part 170*b* being unwound and an increase in the distance from the adjacent extension part 170*b*. Accordingly, the elastic member 990 may be disposed on one surface of the extension part 170*b* so that the extension part 170*b* may be easily unwound from the roller 151.

Guide Member

Figure 12:
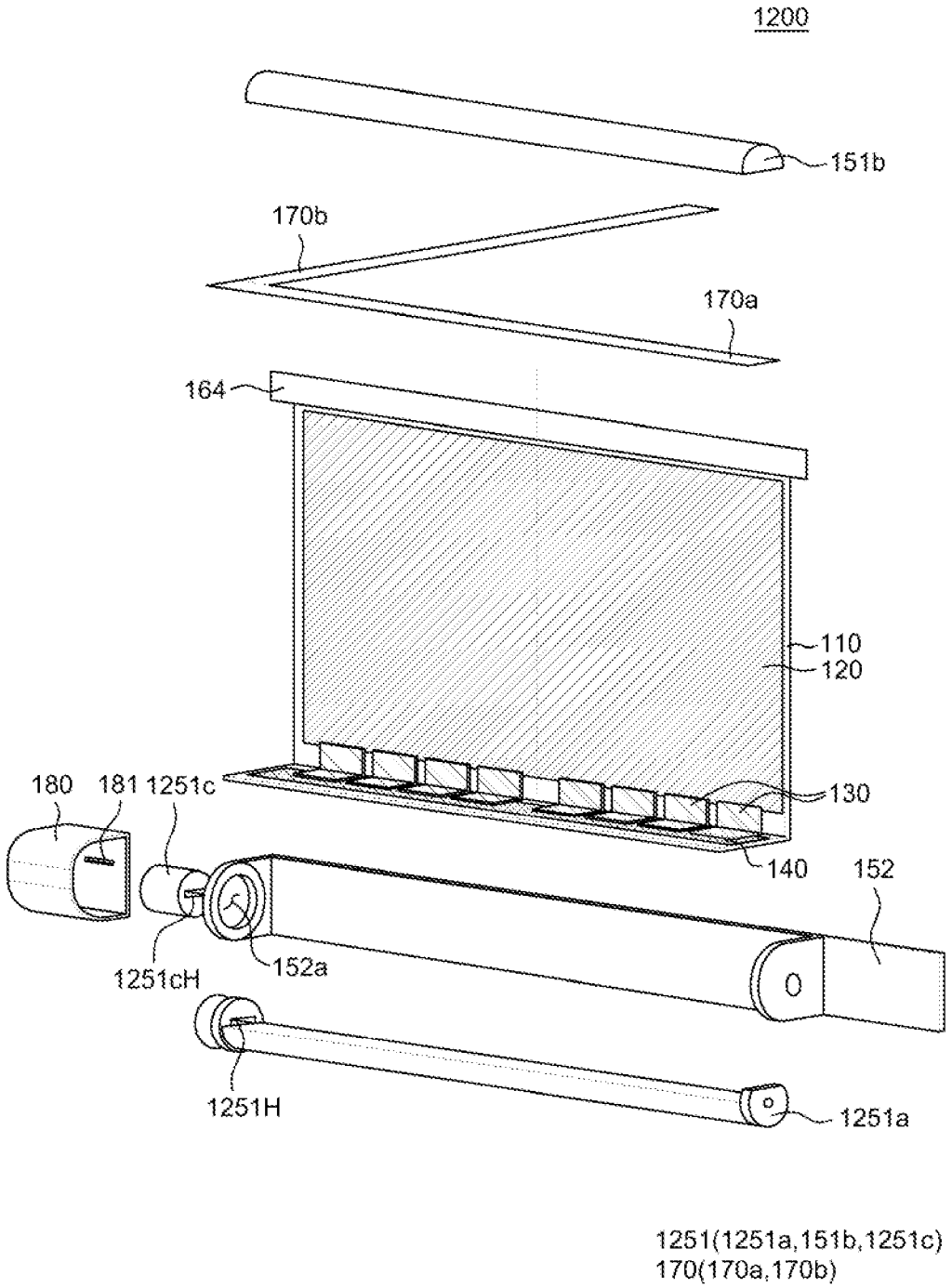
FIG. 12 is an exploded perspective view of a display device according to yet another exemplary embodiment of the present disclosure.

FIG. 12 is an exploded perspective view of a display device according to yet another exemplary embodiment of the present disclosure. A display device 1200 illustrated in FIG. 12 has substantially the same configuration as the display device 100 illustrated in FIG. 1A through FIG. 8 except a roller 1251 and a guide member 1251*c*. Therefore, redundant description of the same components will not be provided.

Referring to FIG. 12, the roller 1251 may include the guide member 1251*c*. The guide member 1251*c* may be disposed on the ends of the cover part 151*b* and a base part 1251*a* of the roller 1251. The guide member 1251*c* may be combined with the cover part 151*b* or the base part 1251*a* to guide the extension part 170*b* about a shape to be wound. The shape of the guide member 1251*c* may be the same as the combined shape of the cover part 151*b* and the base part 1251*a*. That is, the guide member 1251*c* may be formed into a cylindrical shape. However, the diameter of the guide member 1251*c* may be different from the diameter of the roller 1251 in which the cover part 151*b* and the base part 1251*a* are combined to each other.

Referring to FIG. 12, the guide member 1251*c* may include a through-hole 1251*c*H. Thus, the connection part 170*a* of the flexible cable 170 may penetrate a through-hole 1251H formed at the end of the roller 1251 and the through-hole 1251*c*H of the guide member 1251*c* and may be disposed inside the cable cover 180.

Referring to FIG. 12, the extension part 170*b* of the flexible cable 170 may be wound around the guide member 1251*c*. That is, the extension part 170*b* may be wound into a substantially circular shape around the guide member 1251*c*. Thus, when the extension part 170*b* is wound around or unwound from the guide member 1251*c*, a twist may not occur in the extension part 170*b*.

In the display device 1200 according to yet another exemplary embodiment of the present disclosure, the guide member 1251*c* may be disposed on the end of the roller 1251 in order for the extension part 170*b* to be wound around or unwound from the guide member 1251*c*. Thus, during winding or unwinding of the display device 1200, it is possible to suppress a twist of the extension part 170*b*. For example, the shape of the guide member 1251*c* may be the same as the combined shape of the cover part 151*b* and the base part 1251*a*. That is, the guide member 1251*c* may be formed into a cylindrical shape. Thus, when the extension part 170*b* is wound around the guide member 1251*c*, the extension part 170*b* may be wound into a substantially circular shape around the guide member 1251*c*. Therefore, the extension part 170*b* may be wound around the guide member 1251*c* along the shape of the guide member 1251*c*. Accordingly, it is possible to suppress a twist of the extension part 170*b* and thus possible to suppress a short circuit of the extension part 170*b*.

Further, in the display device 1200 according to yet another exemplary embodiment of the present disclosure, the guide member 1251*c* may be designed to have a different diameter from the roller 1251. The diameter of the roller 1251 is determined based on the size of the display panel 120. Therefore, as the size and resolution of the display panel 120 increases, the diameter of the roller 1251 may increase. Also, as the size and resolution of the display panel 120 decreases, the diameter of the roller 1251 may decrease. However, a diameter required for the guide member 1251*c* may be different from a diameter required for the roller 1251. For example, if the extension part 170*b* is formed long, even when the display panel 120 is fully wound around or fully unwound from the roller 1251, the extension part 170*b* may not be fully wound around the guide member 1251*c*. On the contrary, if the extension part 170*b* is formed short, when the display panel 120 is fully wound around or fully unwound from the roller 1251, the extension part 170*b* may be tightly wound around the guide member 1251*c*. Thus, stress may be applied to the extension part 170*b*. Therefore, in the display device 1200 according to yet another exemplary embodiment of the present disclosure, the diameter of the guide member 1251*c* is designed in consideration of the length of the extension part 170*b* of the flexible cable 170. Thus, if the extension part 170*b* is long, the guide member 1251*c* may be designed to have a small diameter so that the number of windings of the extension part 170*b* around the guide member 1251*c* increases. Also, if the extension part 170*b* is short, the guide member 1251*c* may be designed to have a large diameter so that the number of windings of the extension part 170*b* around the guide member 1251*c* decreases.

Layout of Source Printed Circuit Board and Flexible Cable

Figure 13:
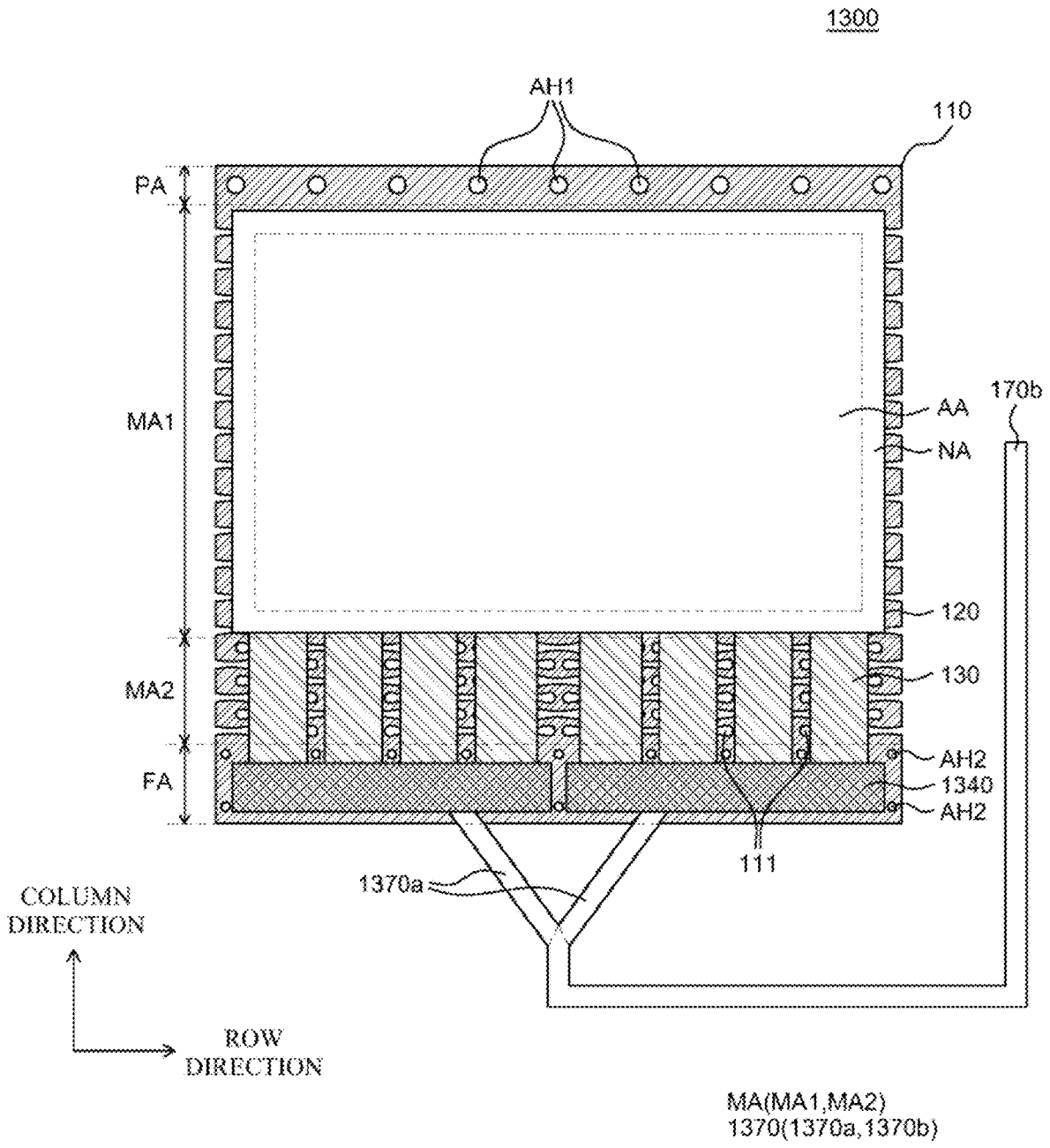
FIG. 13 is a plan view of a display device according to still another exemplary embodiment of the present disclosure.

FIG. 13 is a plan view of a display device according to still another exemplary embodiment of the present disclosure. A display device 1300 illustrated in FIG. 13 has substantially the same configuration as the display device 100 illustrated in FIG. 1A through FIG. 8 except a source printed circuit board 1340 and a flexible cable 1370. Therefore, redundant description of the same components will not be provided.

Referring to FIG. 13, the source printed circuit board 1340 is composed of a plurality of source printed circuit boards. Some of the plurality of flexible films 130 may be connected to a source printed circuit board 1340 and some of the plurality of flexible films 130 may be connected to another source printed circuit board 1340. FIG. 13 illustrates two source printed circuit boards 1340, but the number of source printed circuit boards 1340 is not limited thereto and may be changed variously depending on the design. Also, FIG. 13 illustrates that four flexible films 130 are connected to a single source printed circuit board 1340. However, the number of flexible films 130 connected to a single source printed circuit board 1340 is not limited thereto and may be changed variously depending on the design.

Referring to FIG. 13, the flexible cable 1370 includes a plurality of connection parts 1370*a*. Each of the connection parts 1370*a* may be connected to one end of each source printed circuit board 1340. FIG. 13 illustrates that a single connection part 1370*a* is connected to a single source printed circuit board 1340, but the present disclosure is not limited thereto. Numerous connection parts 1370*a* may also be connected to a single source printed circuit board 1340.

Referring to FIG. 13, the connection parts 1370*a* connected to the respective source printed circuit boards 1340 may be connected to each other between the source printed circuit boards 1340 and the extension part 170*b*. That is, the connection parts 1370*a* may be connected as one and then connected to the extension part 170*b*.

In the display device 1300 according to still another exemplary embodiment of the present disclosure, the connection parts 1370*a* respectively connected to the plurality of source printed circuit boards 1340 may be connected to a single extension part 170*b*. For example, if the source printed circuit board 1340 is composed of a plurality of source printed circuit boards, the plurality of connection parts 1370*a* may be respectively connected to the source printed circuit boards 1340. Also, the plurality of connection parts 1370*a* connected to the respective source printed circuit boards 1340 may be connected as one at the end of the extension part 170*b*. Thus, the driving stability of the display device 1300 may be improved. Also, when the extension part 170*b* is wound around the roller 151, it is possible to suppress a twist of the extension part 170*b*.

Other Structures of Extension Part

Figure 14:
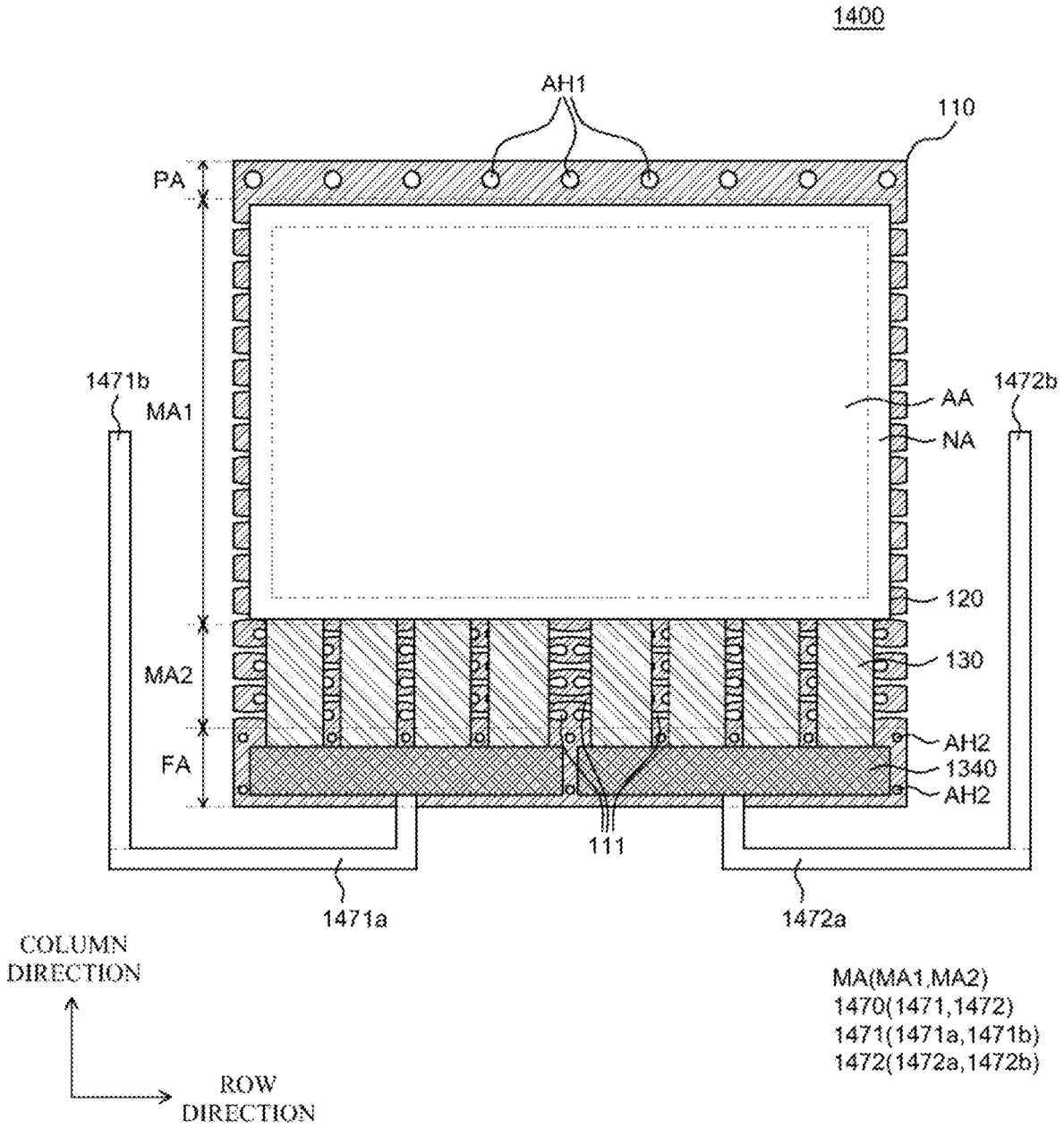
FIG. 14 is a plan view of a display device according to still another exemplary embodiment of the present disclosure.

FIG. 14 is a plan view of a display device according to still another exemplary embodiment of the present disclosure. A display device 1400 illustrated in FIG. 14 has substantially the same configuration as the display device 1300 illustrated in FIG. 13 except a flexible cable 1470. Therefore, redundant description of the same components will not be provided.

Referring to FIG. 14, the flexible cable 1470 is composed of a first flexible cable 1471 and a second flexible cable 1472. The first flexible cable 1471 and the second flexible cable 1472 may include connection parts 1471*a* and 1472*a* and extension parts 1471*b* and 1472*b*, respectively. That is, the first flexible cable 1471 may include a first connection part 1471*a* and a first extension part 1471*b*, and the second flexible cable 1472 may include a second connection part 1472*a* and a second extension part 1472*b*. FIG. 14 illustrates that each flexible cable 1470 includes a single connection part 1471*a* or 1472*a* and a single extension part 1471*b* or 1472*b*, but the present disclosure is not limited thereto. Each flexible cable 1470 may also include a plurality of connection parts 1471*a* and 1472*a* or a plurality of extension parts 1471*b* and 1472*b*.

Referring to FIG. 14, the connection part 1471*a* of the first flexible cable 1471 and the connection part 1472*a* of the second flexible cable 1472 may be respectively connected to different source printed circuit boards 1340. For example, the first flexible cable 1471 may be connected to a source printed circuit board 1340 and the second flexible cable 1472 may be connected to another source printed circuit board 1340. FIG. 14 illustrates that a single connection part 1471*a* or 1472*a* is connected to a single source printed circuit board 1340, but the present disclosure is not limited thereto. A plurality of connection parts 1471*a* and 1472*a* may also be connected to a single source printed circuit board 1340. If a plurality of connection parts 1471*a* and 1472*a* is connected to a single source printed circuit board 1340, some of the plurality of connection parts 1471*a* and 1472*a* may be connected as one and then connected to the first extension part 1471*b* or the second extension part 1472*b*.

Referring to FIG. 14, the first flexible cable 1471 and the second flexible cable 1472 may be respectively wound around both ends of the roller 151. For example, the first extension part 1471*b* of the first flexible cable 1471 may be wound around the left end of the roller 151, which is one end of the roller 151 and the second extension part 1472*b* of the second flexible cable 1472 may be wound around the right end of the roller 151, which is the other end of the roller 151. In this case, winding or unwinding of the first flexible cable 1471 and the second flexible cable 1472 is substantially the same as that of the flexible cable 170 of the display device 100 illustrated in FIG. 1A through FIG. 8. Therefore, a detailed description thereof will be omitted.

In the display device 1400 according to still another exemplary embodiment of the present disclosure, the first flexible cable 1471 and the second flexible cable 1472 of the flexible cable 1470 may be respectively wound around the both different ends of the roller 151. Thus, the length of the connection parts 1471*a* and 1472*a* respectively connecting the source printed circuit boards 1340 and the extension parts 1471*b* and 1472*b* may be reduced. Specifically, the first flexible cable 1471 may include the first connection part 1471*a* and the first extension part 1471*b*, the second flexible cable 1472 may include the second connection part 1472*a* and the second extension part 1472*b*. In this case, the first connection part 1471*a* and the second connection part 1472*a* may be respectively connected to different source printed circuit boards 1340. That is, the first connection part 1471*a* of the first flexible cable 1471 may connect a source printed circuit board 1340 and the first extension part 1471*b* and the second connection part 1472*a* of the second flexible cable 1472 may connect another source printed circuit board 1340 and the second extension part 1472*b*. Thus, the first flexible cable 1471 and the second flexible cable 1472 may be respectively wound around the both different ends of the roller 151. Therefore, the length of the first connection part 1471*a* connecting a source printed circuit board 1340 and the first extension part 1471*b* and the length of the second connection part 1472*a* connecting another source printed circuit board 1340 and the second extension part 1472*b* may be reduced. Accordingly, it is possible to reduce noise of signals transmitted through the flexible cable 1470 and thus possible to improve the reliability of the display device 1400.

Structure in Other Display Devices

Figure 15:
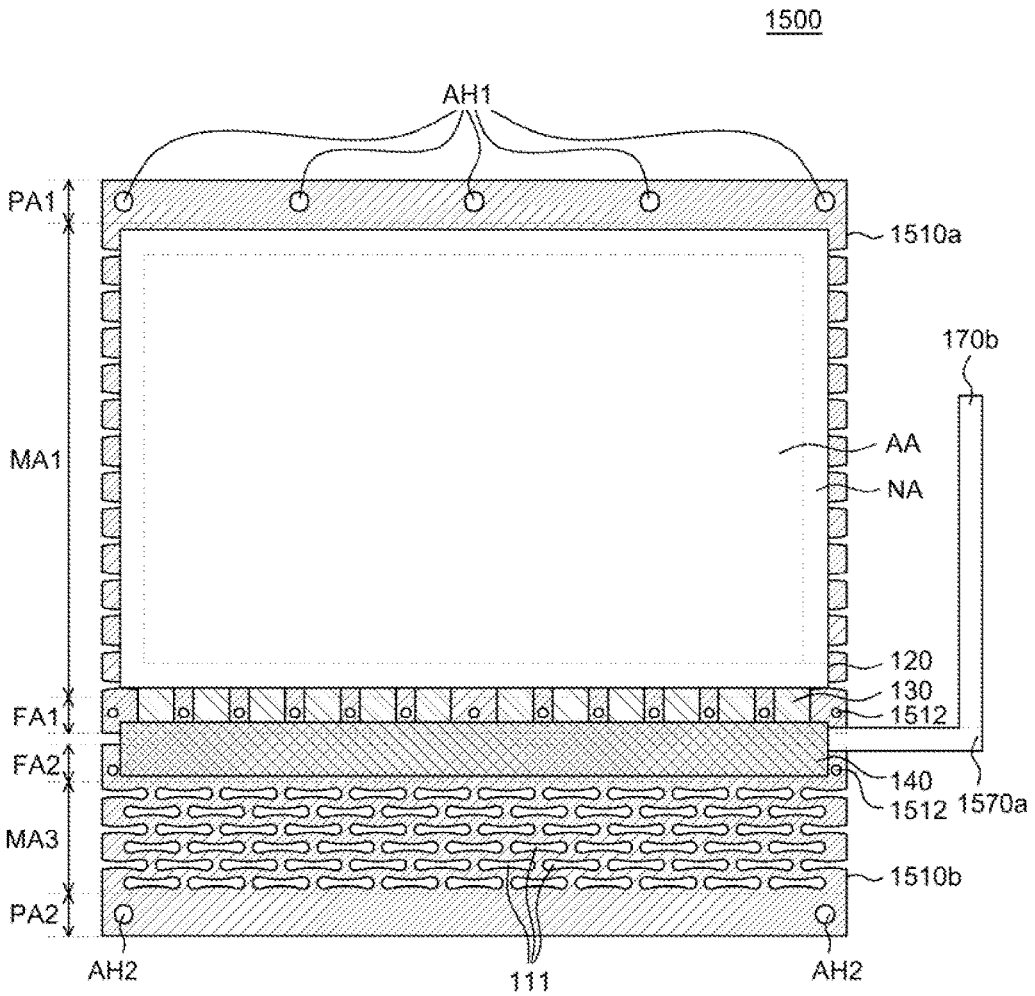
FIG. 15 is a plan view of a display device according to still another exemplary embodiment of the present disclosure.
Figure 15:
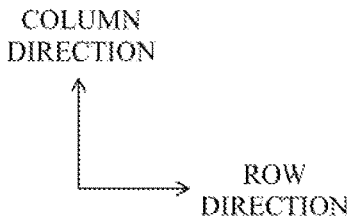

FIG. 15 is a plan view of a display device according to still another exemplary embodiment of the present disclosure. A display device 1500 illustrated in FIG. 15 has substantially the same configuration as the display device 100 illustrated in FIG. 1A through FIG. 8 except a back cover 1510. Therefore, redundant description of the same components will not be provided.

Referring to FIG. 15, the back cover 1510 includes a plurality of support areas PA, a fixing area FA and a plurality of flexible areas MA. In the plurality of support areas PA and the fixing area FA, the plurality of openings 111 is not disposed. In the plurality of flexible areas MA, the plurality of openings 111 is disposed. Specifically, a first support area PA1, a first flexible area MA1, the fixing area FA, a third flexible area MA3 and a second support area PA2 are disposed sequentially from the uppermost end of the back cover 1510.

The first support area PA1 of the back cover 1510 is the uppermost area of the back cover 1510 and combined to the head bar 164. Further, the first flexible area MA1 is extended from the first support area PA1 to the lower side of the back cover 1510. The display panel 120 is attached to the first flexible area MA1. The first support area PA1 and the first flexible area MA1 are the same as the support area PA and the flexible area MA of the display device 100 described above with reference to FIG. 1A through FIG. 8. Therefore, a detailed description thereof will be omitted.

The fixing area FA is extended from the first flexible area MA1 to the lower side of the back cover 1510. In the fixing area FA, the flexible film 130, the source printed circuit board 140 and the connection part 1570*a* of the flexible cable 170 may be disposed. The fixing area FA enables the flexible film 130, the source printed circuit board 140 and the connection part 1570*a* of the flexible cable 170 to be wound so as not to be curved but to be flat around the roller 151. This is to protect the flexible film 130, the source printed circuit board 140 and the connection part 1570*a* of the flexible cable 170. Further, the roller 151 may also be partially flat corresponding to the fixing area FA.

A plurality of fixing holes 1512 is disposed in the fixing area FA. Each of the plurality of fixing holes 1512 is disposed between flexible films 130. Thus, separate structures such as a base plate, a bottom cover, and a top cover are combined through the plurality of fixing holes 1512. Also, during winding or unwinding of the display part DP, stress caused by contraction or expansion and applied to the fixing area FA of the back cover 1510 may be reduced and the flexible film 130 and the source printed circuit board 140 may be more stably fixed. Meanwhile, the number of fixing holes 1512 illustrated in FIG. 15 is just an example and may be determined based on the number of source printed circuit boards 140, the number of flexible films 130, etc.

Meanwhile, the back cover 1510 may be divided into a first back cover 1510*a* and a second back cover 1510*b* with a plurality of fixing holes 1512 in a first fixing area FA1 and a plurality of fixing holes 1512 in a second fixing area FA2 interposed therebetween. That is, the first back cover 1510*a* includes the first support area PA1, the first flexible area MA1 and the first fixing area FA1, and the second back cover 1510*b* includes the second fixing area FA2, the third flexible area MA3 and the second support area PA2. However, the present disclosure is not limited thereto. The back cover 1510 may be formed as one body.

The third flexible area MA3 is extended from the fixing area FA to the lower side of the back cover 1510. In the third flexible area MA3, the plurality of openings 111 is disposed.

The third flexible area MA3 is extended to enable the active area AA of the display panel 120 to be presented outside the housing part HP. For example, when the back cover 1510 and the display panel 120 are in the full unwinding state, the second support area PA2 of the back cover 1510 fixed to the roller 151 and the fixing area FA to which the flexible film 130 and the source printed circuit board 140 are attached may be placed inside the housing part HP. At the same time, the first flexible area MA1 to which the display panel 120 is attached and the fixing area FA may be presented outside the housing part HP. In this case, if a length from the second support area PA2 fixed to the roller 151 to the third flexible area MA3 and the fixing area FA is smaller than a length from the second support area PA2 to the opening HPO of the housing part HP, a part of the first flexible area MA1 to which the display panel 120 is attached may be placed inside the housing part HP. Since a part of a lower end of the active area AA of the display panel 120 is placed inside the housing part HP, it may be difficult to watch images. Therefore, the length from the second support area PA2 fixed to the roller 151 to the third flexible area MA3 and the fixing area FA may be designed to be equal to the length from the second support area PA2 fixed to the roller 151 to the opening HPO of the housing part HP.

The second support area PA2 of the back cover 1510 is the lowermost area of the back cover 1510 and combined and fixed to the roller 151. The second support area PA2 may include the second alignment holes AH2 so as to be combined to the roller 151. In this case, the second support area PA2 may be combined to the roller 151 by screws, but is not limited thereto. Since the second support area PA2 is combined to the roller 151, the back cover 1510 may be wound around or unwound from the roller 151 as the roller 151 is rotated. FIG. 15 illustrates two second alignment holes AH2, but the number of second alignment holes AH2 is not limited thereto. Also, the back cover 1510 may be fixed to the roller 151 without alignment holes.

In the display device 1500 according to still another exemplary embodiment of the present disclosure, the back cover 1510 may be composed of the first back cover 1510*a* and the second back cover 1510*b*. Thus, the back cover 1510 may be formed so as to correspond to various sizes of the display panel 120. As the size of the display device 1500 increases, the size of the display panel 120 also increases. In this case, the back cover 1510 needs to be larger in size than the display panel 120. Therefore, the single back cover 1510 needs to be manufactured to a large size. However, it is very difficult to manufacture the single back cover 1510 corresponding to a large-size display device. Accordingly, in the display device 1500 according to still another exemplary embodiment of the present disclosure, the back cover 1510 is configured including the first back cover 1510*a* and the second back cover 1510*b*. Thus, the first back cover 1510*a* and the second back cover 1510*b* which are smaller in size than the display device 1500 may be used. Also, the first back cover 1510*a* and the second back cover 1510*b* are fixed by separate structures such as a base plate, a bottom cover, and a top cover. Therefore, the first back cover 1510*a* and the second back cover 1510*b* may function as the existing back cover 1510. Also, the back cover 1510 may be manufactured in smaller sizes, and, thus, the productivity may be improved.

Meanwhile, in some exemplary embodiments, a control printed circuit board of the display device 1500 may be disposed inside the roller 151. In this case, a cable for connecting the control printed circuit board to another component, e.g., a power supply unit, of the display device may have the same configuration as the flexible cable described above in various exemplary embodiments of the present disclosure. That is, if the control printed circuit board is disposed inside the roller 151, a cable for connecting the control printed circuit board to another component may be configured to be wound around the end of a roller.

The exemplary embodiments of the present disclosure can also be described as follows:

According to an aspect of the present disclosure, a display device is provided. The display device includes a display panel and a roller configured to wind or unwind the display panel. The display panel also includes a flexible cable configured to transmit an electrical signal to the display panel and including an extension part to be wound around the end of the roller.

The display device may further include a plurality of flexible films placed on one end of the display panel. The display device may further include a source printed circuit board connected to the flexible films. The display device may further include a control printed circuit board electrically connected to the source printed circuit board through the flexible cable. Wherein the flexible cable may further include a connection part electrically connecting the source printed circuit board and the extension part, and the extension part is electrically connected to the control printed circuit board.

The connection part may be electrically connected to the source printed circuit board inside the roller, and the control printed circuit board is placed outside the roller.

The connection part may be placed to overlap the source printed circuit board.

The source printed circuit board may be composed of a plurality of source printed circuit boards, and the connection part may be composed of a plurality of connection parts to be connected to one ends of the respective source printed circuit boards.

The connection parts connected to the respective source printed circuit boards may be connected to each other between the source printed circuit boards and the extension part.

The extension part may be composed of a first extension part and a second extension part, and some of the connection parts may be connected to the first extension part and some of the connection parts are connected to the second extension part, and the first extension part may be wound around one end of the roller, and the second extension part is wound around the other end of the roller.

The connection part may be connected to the source printed circuit board outside the roller, and the roller may include a flat part and a curved part, and during winding of the display panel, the plurality of flexible films and the source printed circuit board may be placed on the flat part.

The display device may further include an elastic member placed on at least one surface of the extension part.

The elastic member may have elasticity that causes an increase in an outermost diameter of the extension part during unwinding of the display panel.

The elastic member may be placed on both surfaces of the extension part.

The elastic member may be a spiral spring.

The roller may include a cover part and a base part combined to the cover part so as to form the shape of the roller, and the extension part may be wound around an end of the cover part or the base part.

The roller may include a cover part, a base part combined to the cover part so as to form the shape of the roller and a guide member placed on ends of the cover part and the base part, and the extension part may be wound around the guide member.

A diameter of the guide member may be different from a diameter of the roller in which the cover part and the base part are combined to each other.

The display device may further include a cable cover placed to cover the end of the roller and the extension part wound around the end of the roller, wherein the cable cover includes a fixing hole through which the extension part penetrates and which fixes the extension part.

According to another aspect of the present disclosure, a display device is provided. The display device includes a display panel configured to display an image and a back cover configured to be rolled together with the display panel. The display device also includes a roller configured to wind or unwind the back cover and the display panel and a plurality of flexible films placed on one end of the display panel. The display device further includes a source printed circuit board connected to the plurality of flexible films. The display device also includes a flexible cable including a connection part connected to the source printed circuit board and an extension part extended from one side of the connection part and configured to be wound as the roller is rotated. The display device further includes a control printed circuit board electrically connected to the source printed circuit board through the flexible cable and an elastic member placed on at least one surface of the extension part.

The connection part and the source printed circuit board may be placed inside the roller, and the control printed circuit board is placed outside the roller.

The connection part may be placed to overlap the source printed circuit board.

The elastic member may be placed on both surfaces of the extension part to loose a shape of the extension part during unwinding of the extension part.

The source printed circuit board may be composed of a plurality of source printed circuit boards, and one or more connection parts may be connected to each of the source printed circuit boards.

The connection parts respectively connected to different source printed circuit boards among the source printed circuit boards may be connected as one.

The flexible cable may be composed of a first flexible cable and a second flexible cable, and the first flexible cable may be wound around one end of the roller, and the second flexible cable may be wound around the other end of the roller.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A display device, comprising:

a display part configured to be in a full winding state or a full unwinding state and including a display panel displaying images and a back cover having a fixing area and a flexible area configured to be rolled together with the display panel;

a roller configured to wind or unwind the display panel and including a cover part and a base part; and a flexible cable configured to transmit an electrical signal to the display panel and including a first extension part winding around an end of the roller and at least one connection part disposed in a flat area of the base part of the roller that is disposed at the fixing area of the back cover to maintain the at least one connection part in a flat state regardless of the display part being in the full winding state or the full unwinding state.

2. The display device according to claim 1, further comprising:

a plurality of flexible films placed on one end of the display panel;

at least one source printed circuit board connected to the plurality of flexible films; and a control printed circuit board electrically connected to the at least one source printed circuit board through the flexible cable, wherein the at least one connection part electrically connects the at least one source printed circuit board and the first extension part, and wherein the first extension part is electrically connected to the control printed circuit board.

3. The display device according to claim 2, wherein the at least one connection part is electrically connected to the at least one source printed circuit board inside the roller, and wherein the control printed circuit board is placed outside the roller.

4. The display device according to claim 2, wherein the at least one connection part is placed to overlap with the at least one source printed circuit board.

5. The display device according to claim 2, wherein the at least one source printed circuit board includes a plurality of source printed circuit boards, and wherein the at least one connection part includes a plurality of connection parts connected with one ends of the respective source printed circuit boards.

6. The display device according to claim 5, wherein the connection parts connected to the respective source printed circuit boards are connected with each other between the source printed circuit boards and the first extension part.

7. The display device according to claim 5, further comprising a second extension part, and portions of the connection parts are connected to the first extension part and portions of the connection parts are connected to the second extension part, and wherein the first extension part is wound around one end of the roller, and the second extension part is wound around another end of the roller.

8. The display device according to claim 2, wherein the at least one connection part is connected to the at least one source printed circuit board outside the roller, and the roller includes a flat part and a curved part, and wherein the plurality of flexible films and the at least one source printed circuit board are placed on the flat part during winding of the display panel.

9. The display device according to claim 1, further comprising an elastic member placed on at least one surface of the first extension part.

10. The display device according to claim 9, wherein the elastic member has elasticity that causes increase in an outermost diameter of the first extension part during unwinding of the display panel.

11. The display device according to claim 9, wherein the elastic member is placed on both surfaces of the first extension part.

12. The display device according to claim 9, wherein the elastic member includes a spiral spring.

13. The display device according to claim 1, wherein the roller includes a cover part and a base part combined to the cover part and forms a shape of the roller, and wherein the first extension part is wound around an end of the cover part or the base part.

14. The display device according to claim 1, wherein the roller includes a cover part and a base part combined to the cover part and forms a shape of the roller and a guide member placed on ends of the cover part and the base part, and wherein the first extension part is wound around the guide member.

15. The display device according to claim 14, wherein a diameter of the guide member is different from a diameter of the roller in which the cover part and the base part are combined to each other.

16. The display device according to claim 1, further comprising a cable cover placed to cover the end of the roller and the first extension part wound around the end of the roller, wherein the cable cover includes a fixing hole through which the first extension part penetrates and which fixes the first extension part.

17. A display device, comprising:

a display panel configured to display an image;

a back cover configured to be rolled together with the display panel;

a roller configured to wind or unwind the back cover and the display panel;

a plurality of flexible films placed on one end of the display panel;

at least one source printed circuit board connected to the plurality of flexible films;

a first flexible cable including at least one connection part connected to the at least one source printed circuit board and an extension part extended from one side of the at least one connection part and configured to be wound as the roller is rotated;

a control printed circuit board electrically connected to the at least one source printed circuit board through the first flexible cable; and an elastic member placed on at least one surface of the extension part.

18. The display device according to claim 17, wherein the at least one connection part and the at least one source printed circuit board are placed inside the roller, and wherein the control printed circuit board is placed outside the roller.

19. The display device according to claim 17, wherein the at least one connection part is placed to overlap with the at least one source printed circuit board.

20. The display device according to claim 17, wherein the elastic member is placed on both surfaces of the extension part and loosens a shape of the extension part during unwinding of the extension part.

21. The display device according to claim 17, wherein the at least one source printed circuit board is composed of a plurality of source printed circuit boards, and at least one connection part includes one or more connection parts connected to each of the source printed circuit boards.

22. The display device according to claim 21, wherein the connection parts respectively connected to different source printed circuit boards among the source printed circuit boards are connected as one.

23. The display device according to claim 21, further comprising a second flexible cable, wherein the first flexible cable is wound around one end of the roller, and the second flexible cable is wound around another end of the roller.

* * * * *